US008910439B2

(12) United States Patent
Ingjaldsdottir et al.

(10) Patent No.: US 8,910,439 B2
(45) Date of Patent: Dec. 16, 2014

(54) WALL PANELS FOR AFFORDABLE, SUSTAINABLE BUILDINGS

(71) Applicants: Erla Dögg Ingjaldsdottir, Santa Monica, CA (US); Tryggvi Thorsteinsson, Santa Monica, CA (US)

(72) Inventors: Erla Dögg Ingjaldsdottir, Santa Monica, CA (US); Tryggvi Thorsteinsson, Santa Monica, CA (US)

(73) Assignee: M3house, LLC, Santa Monica, CA (US)

( * ) Notice: Subject to any disclaimer, the term of this patent is extended or adjusted under 35 U.S.C. 154(b) by 0 days.

(21) Appl. No.: 13/874,326

(22) Filed: Apr. 30, 2013

(65) Prior Publication Data

US 2013/0239487 A1 Sep. 19, 2013

Related U.S. Application Data

(63) Continuation-in-part of application No. 13/107,834, filed on May 13, 2011, now Pat. No. 8,429,871, which is a continuation-in-part of application No. 12/082,418, filed on Apr. 11, 2008, now Pat. No. 7,941,975.

(60) Provisional application No. 60/911,247, filed on Apr. 11, 2007.

(51) Int. Cl.

| | |
|---|---|
| ***E04C 1/00*** | (2006.01) |
| ***E04B 2/30*** | (2006.01) |
| ***E04H 1/00*** | (2006.01) |
| ***E04B 1/348*** | (2006.01) |
| ***E04C 2/38*** | (2006.01) |

(52) U.S. Cl.

CPC .. *E04B 2/30* (2013.01); *E04H 1/00* (2013.01); *E04B 1/3483* (2013.01); *E04C 2/384* (2013.01); *E04B 2001/34892* (2013.01)

USPC ..... 52/309.16; 52/79.12; 52/309.7; 52/782.1

(58) Field of Classification Search

CPC ..... E04B 1/14; E04B 1/24; E04B 2/58; E04C 2/205; E04C 2/22

USPC ..... 52/309.16, 309.7, 79.12, 220.2, 782.1

See application file for complete search history.

(56) References Cited

U.S. PATENT DOCUMENTS

| | | | |
|---|---|---|---|
| 1,886,962 | A | 11/1932 | La Roche |
| 3,386,218 | A | 6/1968 | Scott |

(Continued)

OTHER PUBLICATIONS

EMSEAL, Pre-Formed Sealants and Expansion Joint System, website printout, Apr. 8, 2008, 2 pages, www.emseal.com.

(Continued)

*Primary Examiner* — Basil Katcheves
*Assistant Examiner* — Joshua Ihezie
(74) *Attorney, Agent, or Firm* — Cislo & Thomas, LLP

(57) ABSTRACT

A wall panel configured for quick and easy manufacturing and assembly to create affordable, sustainable buildings. The wall panel has a main wall section having an inside-facing surface and an outside-facing surface opposite the inside-facing surface; a first set of elongated studs embedded in the outside-facing surface of the main wall section, each elongated stud in the first set of elongated studs having a length; a second set of elongated studs embedded in the inside-facing surface of the main wall section, each elongated stud in the second set of the elongated studs having a length; wherein the length of each elongated stud of the first set of elongated studs is greater than a height of the main wall section, and wherein the length of each elongated stud of the second set of elongated studs is equivalent to the height of the main wall section.

20 Claims, 37 Drawing Sheets

(56) References Cited

U.S. PATENT DOCUMENTS

| | | | | | |
|---|---|---|---|---|---|
| 3,750,366 | A | | 8/1973 | Rich et al. | |
| 3,789,567 | A | | 2/1974 | Rae et al. | |
| 3,885,368 | A | | 5/1975 | King et al. | |
| 4,068,430 | A | | 1/1978 | van der Lely | |
| 4,196,555 | A | | 4/1980 | Henges et al. | |
| 4,464,877 | A | | 8/1984 | Gebhardt et al. | |
| 4,557,081 | A | | 12/1985 | Kelly | |
| 4,633,634 | A | * | 1/1987 | Nemmer et al. | 52/474 |
| 4,641,468 | A | * | 2/1987 | Slater | 52/309.4 |
| 4,744,185 | A | | 5/1988 | Lamberet et al. | |
| 4,759,158 | A | | 7/1988 | Aubry | |
| 4,787,189 | A | * | 11/1988 | Haug et al. | 52/415 |
| 5,038,534 | A | | 8/1991 | Pollock | |
| 5,067,296 | A | * | 11/1991 | Brown et al. | 52/309.7 |
| 5,233,803 | A | | 8/1993 | Bockmiller | |
| 5,237,786 | A | | 8/1993 | Kochansky | |
| 5,279,089 | A | | 1/1994 | Gulur | |
| 5,305,563 | A | | 4/1994 | Erel | |
| 5,305,567 | A | | 4/1994 | Wittler | |
| 5,313,751 | A | | 5/1994 | Wittler | |
| 5,410,852 | A | | 5/1995 | Edgar et al. | |
| 5,412,913 | A | | 5/1995 | Daniels et al. | |
| 5,412,918 | A | | 5/1995 | Wendel et al. | |
| 5,491,934 | A | | 2/1996 | Bigelow et al. | |
| 5,524,400 | A | * | 6/1996 | Schmechel | 52/474 |
| 5,540,025 | A | | 7/1996 | Takehara et al. | |
| 5,666,774 | A | | 9/1997 | Commins | |
| 5,694,729 | A | | 12/1997 | Blackburn et al. | |
| 5,711,128 | A | | 1/1998 | Kordelin | |
| 5,740,647 | A | | 4/1998 | Kelly | |
| 5,755,063 | A | | 5/1998 | Ohnishi et al. | |
| 5,799,462 | A | * | 9/1998 | McKinney | 52/742.13 |
| 5,822,940 | A | * | 10/1998 | Carlin et al. | 52/479 |
| 5,845,457 | A | | 12/1998 | Wybauw | |
| 5,884,435 | A | | 3/1999 | David et al. | |
| 5,904,009 | A | | 5/1999 | Huang | |
| 5,934,037 | A | | 8/1999 | Bundra | |
| 6,006,482 | A | | 12/1999 | Kelly | |
| 6,006,487 | A | | 12/1999 | Leek | |
| 6,016,632 | A | | 1/2000 | McGee et al. | |
| 6,018,918 | A | | 2/2000 | Long | |
| 6,058,668 | A | | 5/2000 | Herren | |
| 6,073,401 | A | | 6/2000 | Iri et al. | |
| 6,094,875 | A | | 8/2000 | Laine | |
| 6,152,377 | A | | 11/2000 | Fiedrich | |
| 6,164,035 | A | * | 12/2000 | Roberts | 52/563 |
| 6,167,624 | B1 | * | 1/2001 | Lanahan et al. | 29/897.32 |
| 6,188,839 | B1 | | 2/2001 | Pennella | |
| 6,192,641 | B1 | | 2/2001 | Andraso et al. | |
| 6,237,293 | B1 | | 5/2001 | Gembala | |
| 6,332,298 | B1 | | 12/2001 | Bigelow | |
| 6,393,774 | B1 | | 5/2002 | Fisher | |
| 6,415,557 | B1 | | 7/2002 | McCalley | |
| 6,421,968 | B2 | | 7/2002 | Degelsegger | |
| 6,421,972 | B1 | * | 7/2002 | Dalphond et al. | 52/309.7 |
| 6,493,996 | B1 | | 12/2002 | Alexander et al. | |
| 6,550,197 | B1 | | 4/2003 | Gray | |
| 6,571,523 | B2 | * | 6/2003 | Chambers | 52/309.2 |
| 6,578,343 | B1 | | 6/2003 | Dumler et al. | |
| 6,632,048 | B2 | | 10/2003 | Greenberg | |
| 6,651,393 | B2 | | 11/2003 | Don et al. | |
| 6,658,799 | B1 | | 12/2003 | Stoodley | |
| 6,668,499 | B2 | | 12/2003 | Degelsegger | |
| 6,691,482 | B1 | | 2/2004 | Ault | |
| 6,698,147 | B2 | | 3/2004 | Bergman | |
| 6,725,617 | B2 | | 4/2004 | Cox | |
| 6,745,533 | B2 | | 6/2004 | Yamashita et al. | |
| 6,826,879 | B1 | | 12/2004 | Allen et al. | |
| 6,857,237 | B1 | * | 2/2005 | Dalphond et al. | 52/309.7 |
| 6,922,960 | B2 | | 8/2005 | Sataka | |
| 6,925,761 | B1 | | 8/2005 | De La Marche | |
| 6,969,832 | B1 | | 11/2005 | Daughtry | |
| 6,976,337 | B2 | | 12/2005 | Hiraki | |
| 7,409,800 | B2 | | 8/2008 | Budge | |
| 7,484,339 | B2 | | 2/2009 | Fiehler | |
| 7,540,120 | B2 | | 6/2009 | Miller | |
| 7,543,419 | B2 | * | 6/2009 | Rue | 52/630 |
| 7,594,361 | B2 | | 9/2009 | Tragant Ruano | |
| 7,628,949 | B2 | | 12/2009 | Blackmore | |
| 7,802,403 | B2 | | 9/2010 | Finnerty et al. | |
| 7,963,080 | B1 | * | 6/2011 | Bowman | 52/414 |
| 8,109,055 | B2 | | 2/2012 | Miller | |
| 8,109,058 | B2 | * | 2/2012 | Miller | 52/309.7 |
| 8,234,833 | B2 | * | 8/2012 | Miller | 52/745.05 |
| 8,397,387 | B2 | * | 3/2013 | Cole et al. | 29/897.34 |
| 8,555,585 | B2 | * | 10/2013 | Dickens | 52/309.9 |
| 8,561,371 | B2 | * | 10/2013 | Sanders et al. | 52/764 |
| 2001/0009084 | A1 | | 7/2001 | Wolfrum | |
| 2001/0029712 | A1 | | 10/2001 | Emaus et al. | |
| 2002/0020137 | A1 | | 2/2002 | Commins | |
| 2002/0059756 | A1 | * | 5/2002 | Matsubara | 52/79.12 |
| 2002/0078638 | A1 | | 6/2002 | Huang | |
| 2002/0170243 | A1 | | 11/2002 | Don et al. | |
| 2002/0170250 | A1 | * | 11/2002 | Chambers | 52/270 |
| 2003/0056445 | A1 | | 3/2003 | Cox | |
| 2003/0163965 | A1 | | 9/2003 | Hydock | |
| 2004/0006940 | A1 | | 1/2004 | Gray | |
| 2004/0068948 | A1 | * | 4/2004 | Wrass | 52/309.7 |
| 2004/0118069 | A1 | | 6/2004 | Budge | |
| 2005/0073079 | A1 | | 4/2005 | Kanjee | |
| 2005/0204697 | A1 | * | 9/2005 | Rue | 52/782.1 |
| 2005/0210762 | A1 | | 9/2005 | Broberg | |
| 2005/0257494 | A1 | * | 11/2005 | Brandes | 52/782.1 |
| 2006/0000184 | A1 | | 1/2006 | Kannankeril et al. | |
| 2006/0196132 | A1 | | 9/2006 | Ruano | |
| 2007/0044392 | A1 | | 3/2007 | LeBlang | |
| 2007/0074465 | A1 | | 4/2007 | Kuan | |
| 2007/0107339 | A1 | | 5/2007 | Matsumoto | |
| 2007/0193124 | A1 | | 8/2007 | Thompson | |
| 2007/0227086 | A1 | * | 10/2007 | Beavers et al. | 52/309.7 |
| 2007/0271857 | A1 | | 11/2007 | Heather et al. | |

OTHER PUBLICATIONS

Kama, Kama Energy Efficient Building Systems Panels, website printout, Apr. 8, 2008, 2 pages, www.kama-eebs.com.

* cited by examiner

WALL PANELS FOR AFFORDABLE, SUSTAINABLE BUILDINGS

CROSS-REFERENCE TO RELATED APPLICATION

This patent application is a continuation-in-part of U.S. patent application Ser. No. 13/107,834, filed on May 13, 2011 (now U.S. Pat. No. 8,429,871), which is a continuation-in-part application of U.S. patent application Ser. No. 12/082,418, filed on Apr. 11, 2008 (now U.S. Pat. No. 7,941,975), which claims the benefit of U.S. Provisional Patent Application Ser. No. 60/911,247 filed on Apr. 11, 2007, which applications are incorporated in their entirety here by this reference.

TECHNICAL FIELD

This invention relates to buildings made primarily of factory-built, recyclable materials, and methods of constructing and deconstructing such buildings in an affordable, sustainable, and economically- and environmentally-sensitive manner.

BACKGROUND

The cost of housing and other buildings are extremely high in many areas of the world, and particularly in certain parts of the United States. The desire and need for affordable housing is strong and continuous. In addition, the substantial amount of waste generated in the process of constructing and deconstructing housing and other structures, as well as recent trends in the United States and throughout the world, have made clear the desirability of sustainable, environmentally sensitive structures, including for housing.

Thus, a present and increasing need exists for housing and other buildings such as commercial buildings to be built using "green" materials, systems, and technologies that will make such structures economically- and environmentally-sensitive.

SUMMARY OF THE INVENTION

The present invention relates to a new construction paradigm for 21$^{st}$ century housing needs that is efficiently constructed and environmentally friendly to produce a high performance, near net-zero energy, sustainable, affordable, and modern building system.

With the foregoing in mind, one aspect of the present invention is to increase the environmental friendliness of buildings by lowering the carbon footprint of edifice construction through the use of renewable, recyclable, re-usable products for structures built in accordance with the present invention, and by making careful analysis of the life cycle of such products (e.g., determine how much energy was used to make such products, and how much toxicity was removed from them). Ultimately, the goal is to find products that are the most efficiently made, and least polluting, in production, that provide a healthy indoor air quality and environment, and that are easy to recycle.

Another aspect of the present environmentally- and economically-sensitive building paradigm is automation and streamlining of the construction process, which are keys to reducing cost, reducing waste, and increasing efficiency. High costs of labor, insurance, fuel, materials, and waste removal each contribute to the high cost of construction and consequently high cost of living. Costs may be cut by requiring less handling, less processing, less cutting, and less material waste that is so characteristic of the home and office construction industry at present.

Streamlining the design and construction of a home or office structure may be achieved by utilizing a standardized system of mass-produced, prefabricated products. Using mass-produced products fabricated under controlled, efficient conditions in a factory will reduce the amount of cutting and waste prevalent in construction.

Intelligent design, material selection, and utilization of materials fabricated under carefully controlled, factory conditions each increase efficiency, and reduce unnecessary cost and material waste.

A goal of the present invention, therefore, is to build home and office structures, and other structures that come within the spirit of the present invention, using where possible environmentally sensitive building parts that are rapidly and efficiently prepared at a factory or other similar manufacturing facility, that are capable of rapid assembly at the construction site, and that ultimately, at the end of building life cycle, are capable of easy disassembly for re-use or recycling. Every part of a structure is intended to have maximum use during its life cycle and intended to be susceptible to recycling and re-use. Use of such materials, for example, metals, foams that can be re-ground, rubber, and plastics, in building (as opposed to wood and plaster, which are not susceptible to recycling and re-use, just disposal) reduces waste costs and space needed to house waste products, which ultimately benefits the environment and the economy.

Developing sustainable and affordable housing is comprised of some or all of the following steps: (a) designing environmentally and economically sound structures having passive and active design principles; (b) reducing the building's carbon footprint; (c) selecting and using in construction "green" materials, systems, and technologies that are sustainable; (d) using a high percentage of recycled content; (e) using easily deconstructed and recycled parts that can be re-used at the end of the building's life cycle; (f) causing zero waste, diverting all materials away from the landfill; (g) promoting energy efficiency, including designing an energy-efficient building envelope by selecting external wall systems and door/window packages with high "R" (thermal resistance) and "U" (heat transmission) values; (h) taking advantage of thermo mass to reduce the mechanical load and minimize energy use and cost; (i) using renewable energy, including solar and geothermal energy where possible; (j) selecting materials with low embodied energy; (k) selecting standard size materials with lower cost manufacturing and customization.

A building in accordance with the present invention comprises substantially entirely prefabricated constituent parts manufactured off-site, the prefabricated constituent parts comprising a foundation; a frame module comprising a plurality of frames, wherein the frame module is secured to the foundation; a reversible connector to connect the plurality of frames to form the frame module; a wall panel configured to be mounted on to the frame module; a floor panel configured to be mounted on to the frame module; and a ceiling panel configured to be mounted on to the frame module.

Briefly, a foundation is laid at the construction site. Autonomous frame modules are erected by connecting a plurality of individual frames, such as beams and columns, together using reversible connectors. Once the frame module is erected and attached to the foundation, additional frame modules may be erected connected to existing frame modules and/or the panels may be attached to the frame modules to create individual rooms. These panels may be the walls, doors, windows, sliding glass doors, and the like.

Each of these constituent parts may be selected from a cataloged library of parts and components that can be used to build home and office structures. The manufacturing process then becomes the careful selection and assembly of the existing library parts. Nonetheless, substantial creativity can also be applied to the process of designing a home or other building using the library of parts, as further detailed below.

Each frame module is a complete autonomous building block that can not only be operatively connected to other frame modules, but also to which multiple constituent of parts, selected from a library of parts, may be operatively connected. The frames may be prepared according to a variety of shapes and sizes, but are preferably prepared in shapes and sizes that can be easily manufactured, such as frames having dimensions that are a multiple of a standard size, such as eight feet. Likewise, the panels can be constructed in accordance with the various aspects of a house or office building (e.g., doors, windows, cabinets, staircases, etc.), thus providing great flexibility in designing and customizing construction projects.

To achieve a sustainable, zero-energy, or near zero-energy home or office building, the present invention contemplates the use of products, technologies, and design methods such as: (a) passive design (e.g., taking advantage of building orientation, cross ventilation, thermo mass); (b) high "R" value exterior walls, low "E" dual glaze glass, efficient "U" value doors and windows for reduced energy consumption; (c) the latest technology to even further lower the energy load on a home or office building, including LED lighting, high-performance appliances by BOSCH, solar hot water, low-flow plumbing fixtures, and a high "R" value building envelope; and, (d) renewable energies such as PV panels to offset additional energy load and reduce it to or near zero.

DETAILED DESCRIPTION OF THE INVENTION

Figure 1A:
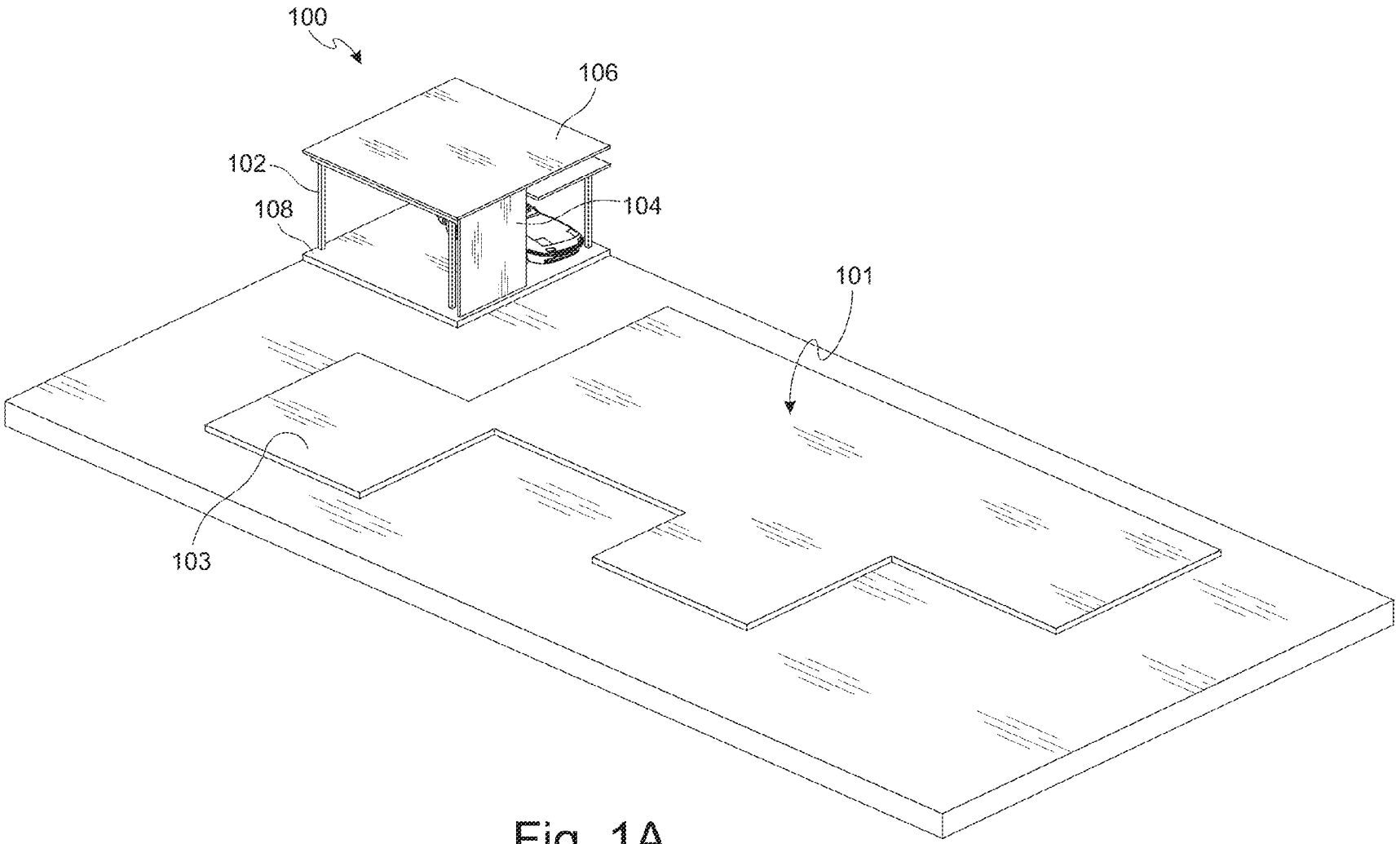
FIG. 1A-D are perspective views of an embodiment of the current invention progressing from a beginning stage of construction to an end stage of construction.
Figure 1B:
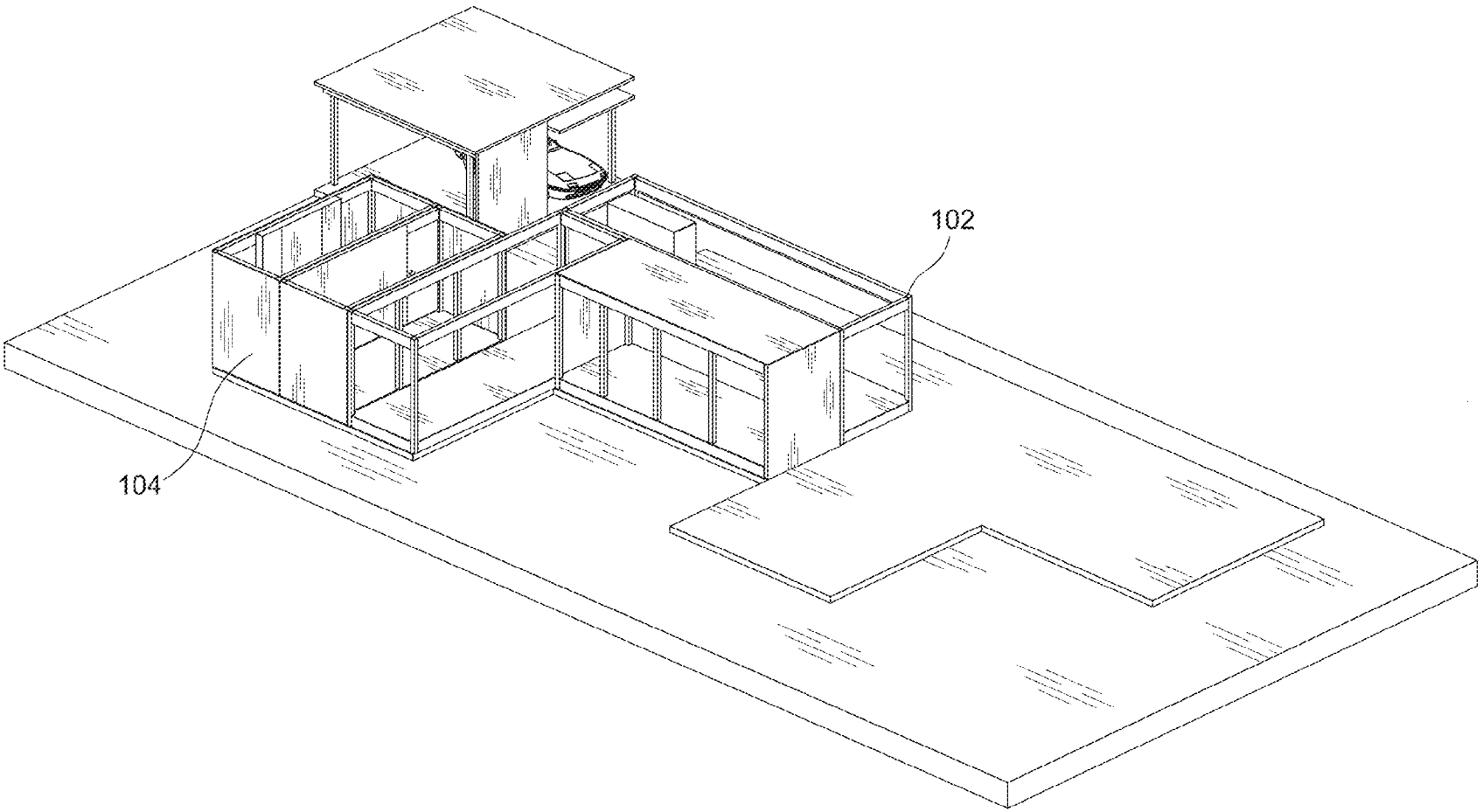
Figure 1C:
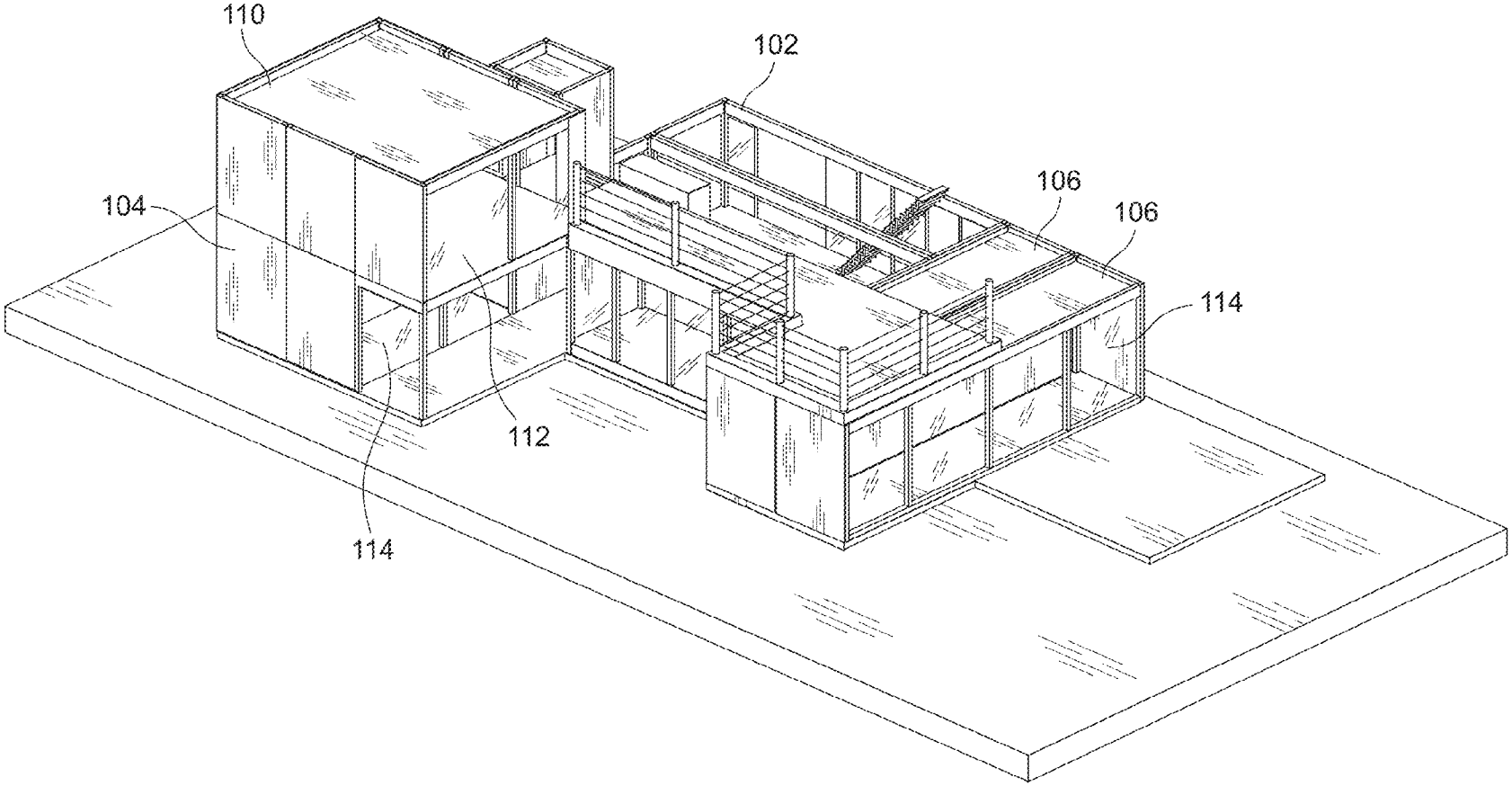
Figure 1D:
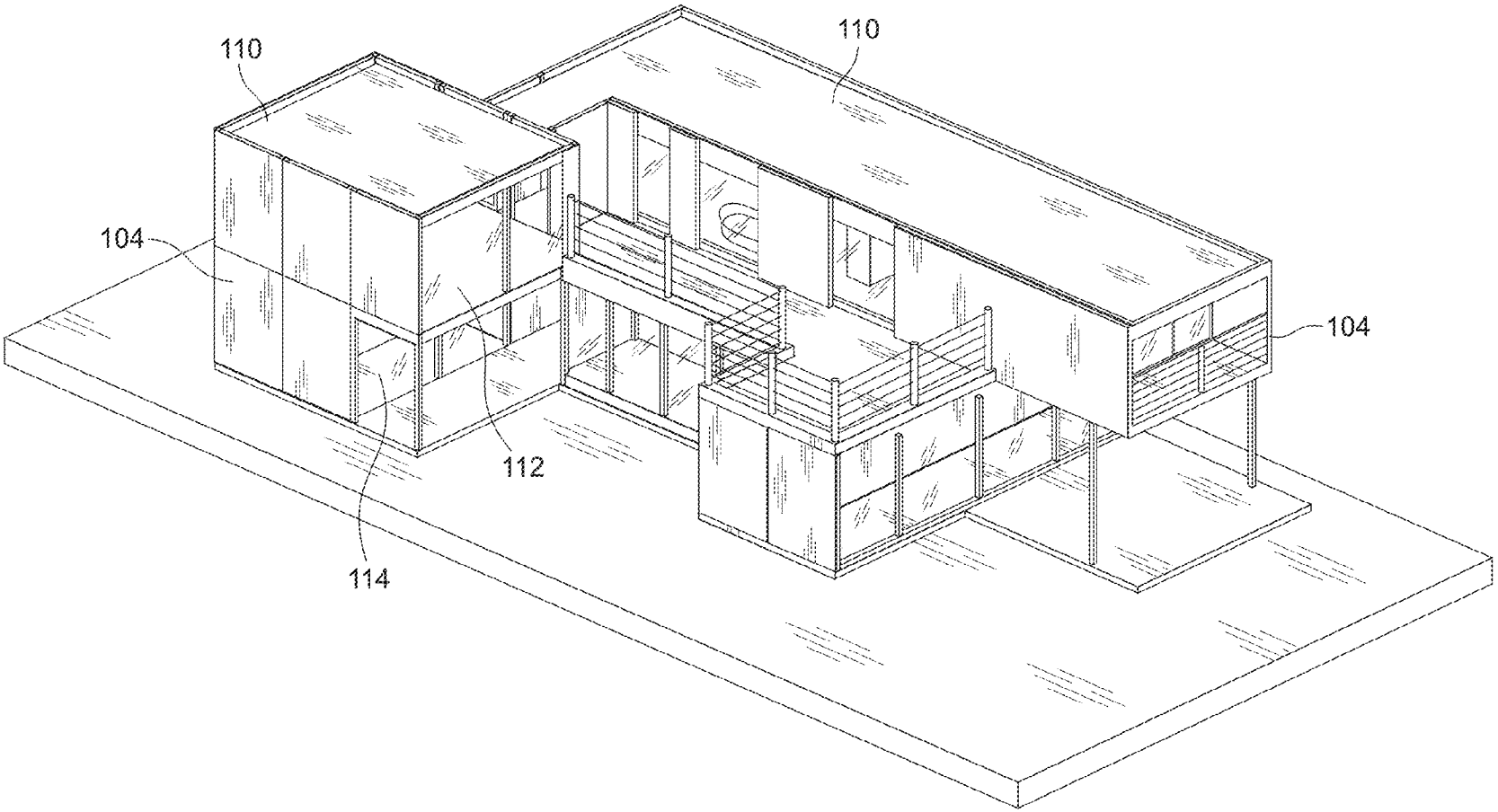

The detailed description set forth below in connection with the appended drawings is intended as a description of presently preferred embodiments of the invention and is not intended to represent the only forms in which the present invention may be constructed, utilized, or practiced. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The present invention is directed towards a building 100 and a method of constructing a building 100 in an economical, efficient, and environmentally friendly fashion, so as to make buildings affordable and better preserve the environment. A building 100 used herein refers to any structure that is used as an edifice for living or working, such as houses, condominiums, town homes, office buildings, stores, hotels, motels, and the like. The economy of constructing such a building may be accomplished by establishing a library of parts comprising prefabricated, constituent parts used to manufacture the building, wherein the constituent parts are easily mass produced due to the use of standardized sizing. The efficiency of construction reduces labor and machining time to save energy during construction, thereby reducing pollutants emitted from use of such machines. Such buildings 100 can further be made environmentally friendly by using predominantly recyclable material to minimize waste.

As shown in FIGS. 1A-1D, a building 100 in accordance with the present invention is assembled as individual modules that are connected to each other, module by module, more quickly and easily than constructing traditional buildings. The modules comprise constituent parts that can be mass-produced off-site, under controlled conditions to increase efficiency and decrease waste. In some embodiments, some constituent parts may be produced on-site. These constituent parts are a part of a library of parts from which a purchaser can select and purchase to be used in the design and construction of a building. Thus, unlike constructing traditional buildings, which takes place completely on site, constructing the building of the present invention comprises purchasing mass-produced prefabricated constituent parts selected from a library of parts and assembling the constituent parts on site using simple tools.

In some embodiments, a grid 101 may be laid down on the foundation 300 to map out the dimensions and arrangement of each frame module 102 to facilitate the proper placement of each frame module 102. The grid 101 comprises a plurality of sections 103, either squares or rectangles with the precise dimensions being determined by industry standards. For example, according to current industry standards the length of a beam is a factor of 8 feet. Therefore, each section 103 of the grid may be 8 feet by 8 feet. Alternatively, the dimensions of the sections 103 may be in factors of 2 feet or 4 feet. Utilizing a standardized sizing still allows for versatility in design as the frame modules can be attached to each other in a variety of arrangements, such as side-to-side (for wider rooms), end-to-end (for longer rooms), or end-to-side (for rooms of different shapes).

As shown in FIGS. 2A-F and 3A-E, a building 100 made of recyclable materials comprises a frame module 102 and a plurality of panels. In general, panels refer to parts that may be operatively connected to the frame module. A non-exhaustive list of examples of panels include a wall panel 104, a ceiling panel 106, a floor panel 108, a roof panel 110, a window panel 112, a sliding glass door panel 114, a door panel, and the like. The frame module 102 provides the infrastructure, or skeleton, for the building 100, and the panels provide the walls, floors, ceilings, windows, and doors for the building 100. A building 100 is defined herein as any commercial or residential building, house, dwelling place, shelter, office, and the like.

Figures 2A, 2B, 2C, 2D, 2E, 2F:
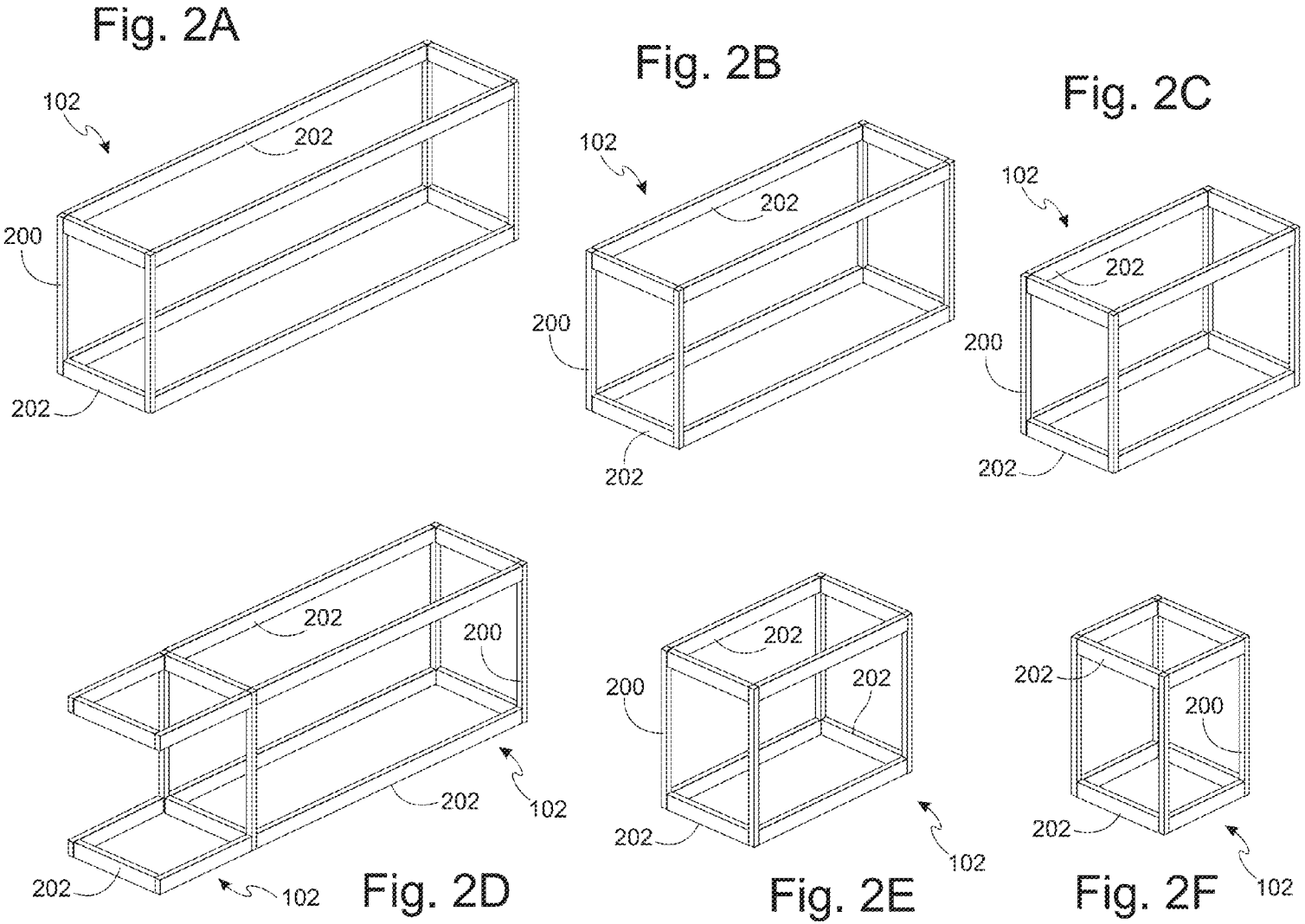
FIG. 2A-F are perspective views of embodiments of frame modules of the present invention.
Figure 3A:
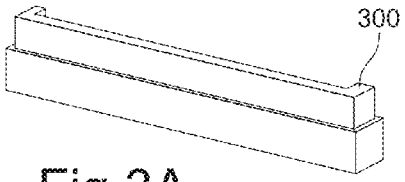
FIG. 3A is a perspective view of an embodiment of a foundation of the present invention.
Figure 3B:
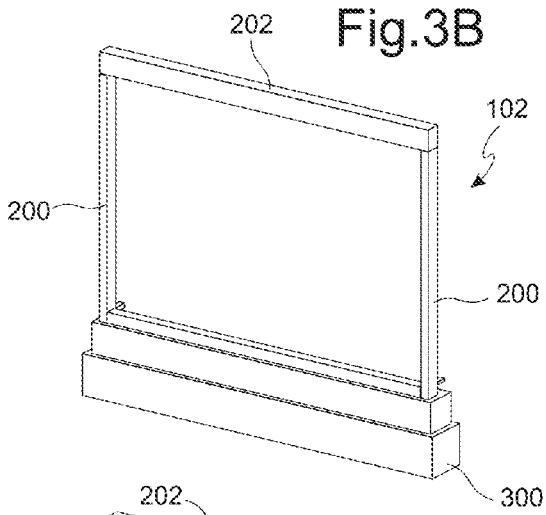
FIG. 3B is a perspective view of a portion of a frame module attached to a foundation.
Figure 3C:
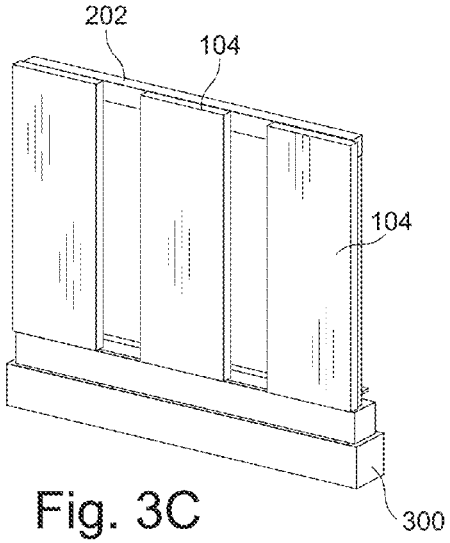
FIG. 3C-E are perspective views of panels attached to a frame module on a foundation.
Figure 3D:
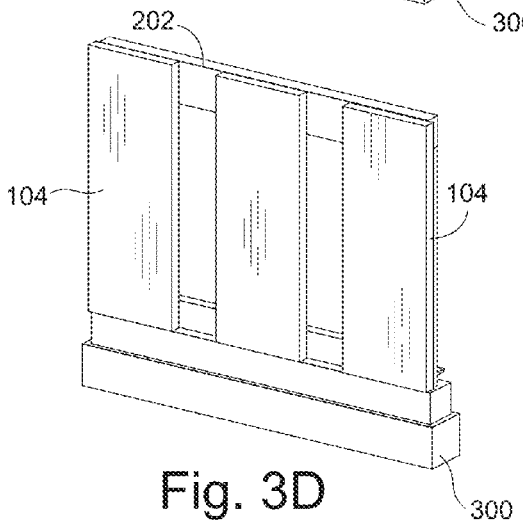
Figure 3E:
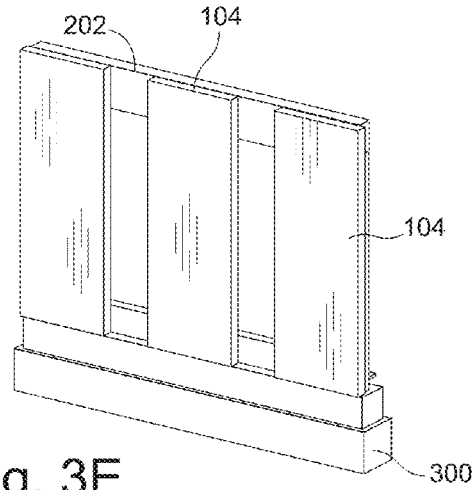

The frame module 102 comprises a plurality of individual frames, such as columns 200 (for vertical support) and beams 202 (for horizontal support) assembled together using reversible connectors 1100, such as bolts and screws, to facilitate construction and deconstruction. This can be accomplished on-site or off-site. The beams 202 may come in a variety of sizes and the entire frame module 102 may be made with recycled steel. Preferably the beam 202 comes in lengths of a predetermined unit. For example, the predetermined unit may be approximately 8 feet. In other words, a beam 202 may be 8, 16, 24, 32, etc. feet long as shown in FIGS. 2A-D. Thus, a frame module 102 may have dimensions of 8 feet wide by (n×8) feet long, where n is a positive integer. Units of 8 feet were selected based on common industry standards. Frame sizes, however, may be any length desired to accommodate the needs of the occupant as shown in FIGS. 2E and 2F. The goal is to minimize the varying lengths so as to maximize the creation of the library of parts.

The preferred column 200 length is 10 feet 6 inches to provide ample room from floor to ceiling. Thus, a typical frame module 102 may have dimensions of 8 feet wide, (n×8) feet long, and 10.5 feet high. To create a wider room, frame modules 102 may be placed adjacent to each other. To create a longer room, either longer beams 202 may be used or two frame modules 102 may be placed adjacent to each other. This process may be repeated with frame modules of varying sizes until an entire room is constructed. A room includes any space delineated from another space by at least one wall.

Figure 4:
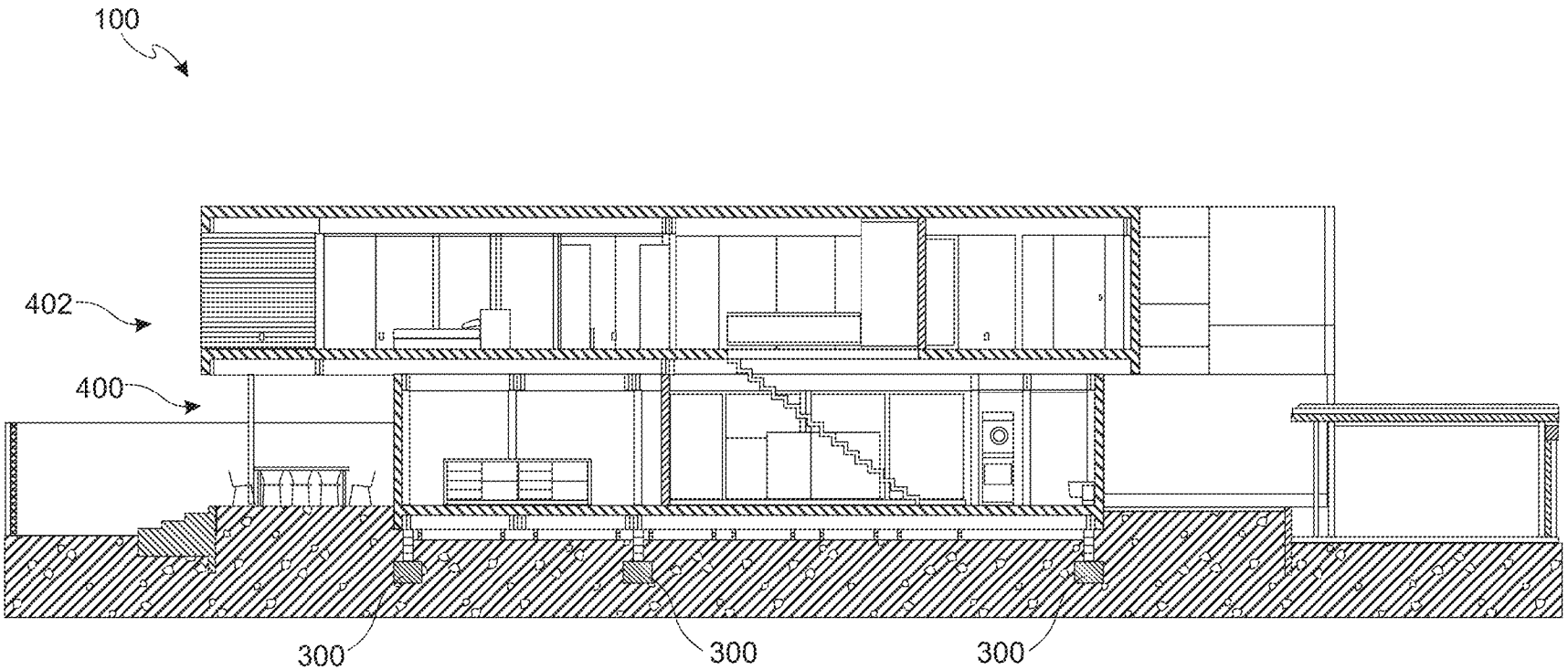
FIG. 4 is an elevation view of a house constructed according to the present invention.
Figure 5:
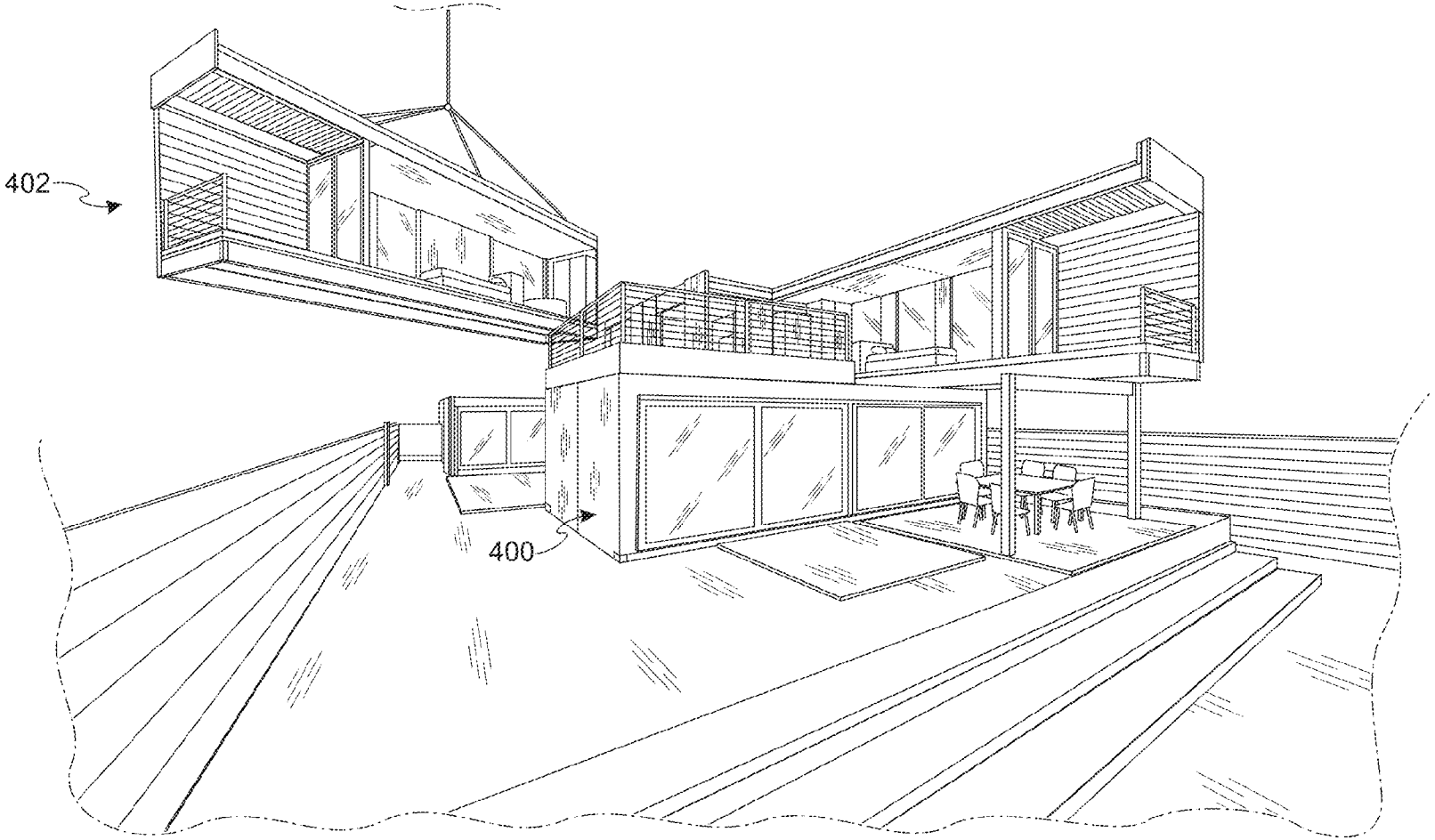
FIG. 5 is a perspective view of showing the addition of a second floor according to the present invention.

The frame module 102 on the ground floor is attached to a foundation 300 to create stability and safety as shown in FIG. 4. Once the frame modules 102 are secured, the panels 104, 106, 108 and/or 110 may be attached to the frame module 102 as shown in FIGS. 3A-3E to construct a room. After a first floor 400 is assembled, a second floor 402 may be similarly assembled, then hoisted on top of the first floor 400 with the use of a crane or similar apparatus to add on a second story 402 as shown in FIG. 5.

Figure 6:
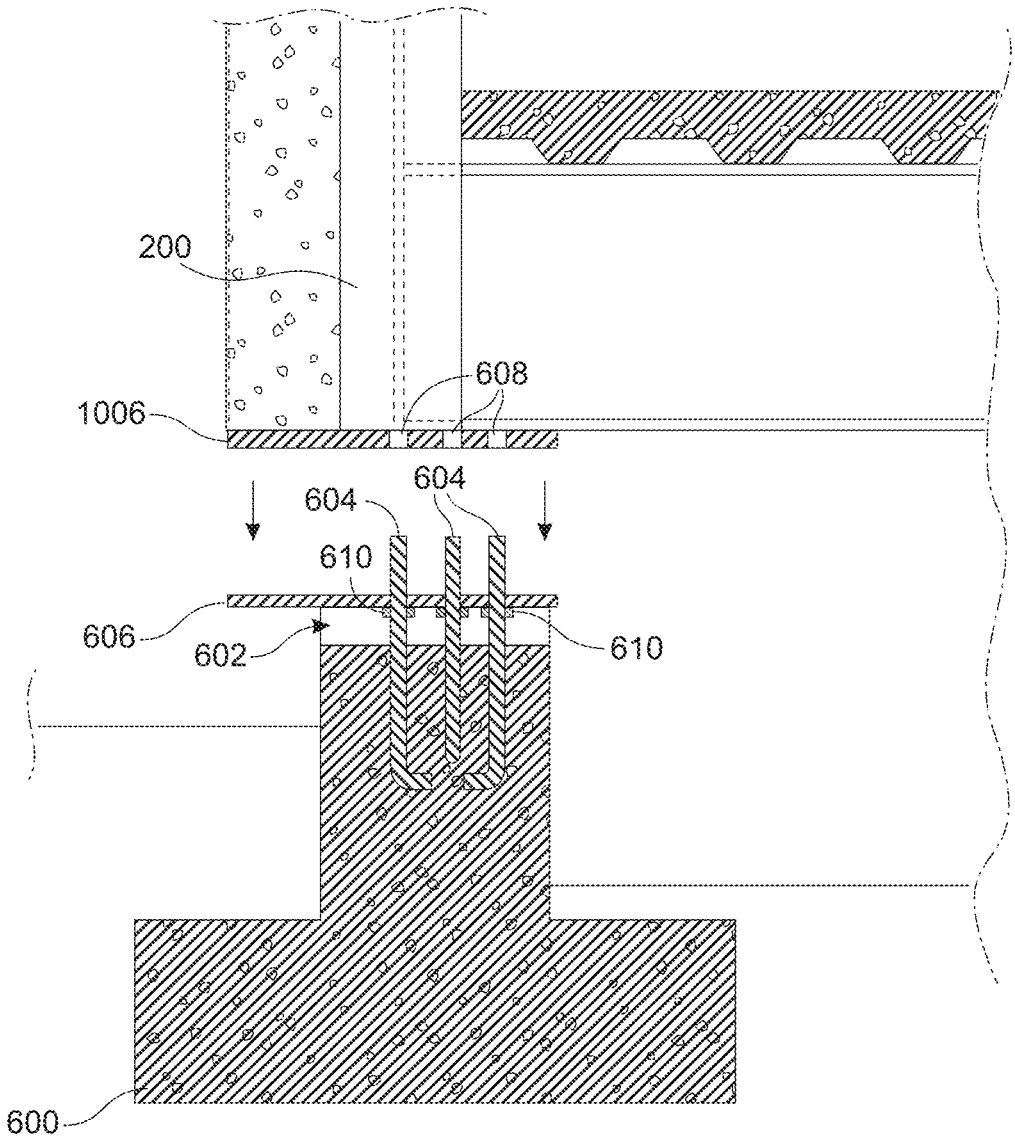
FIG. 6 is another embodiment of a foundation of the present invention.

Due to the precise alignment required to connect adjacent frame modules 102 so as to render them weatherproof, the foundation 300 requires a means for accomplishing precise alignment. As shown in FIG. 6, the foundation 300 comprises a base 600, an adjustment chamber 602 secured to the top of the base 600, at least one adjusting bar 604 secured in the base, protruding out from the top of the base 600 through the adjustment chamber 602, and a foundation plate 606 comprising a hole 608, wherein the foundation plate 606 rests on top of the adjustment chamber 602 and wherein the foundation plate 606 is aligned such that the adjustment bar 604 passes through the bar hole 608. The adjustment bar 604 is threaded and comprises a nut 610. The nut 610 is accessed through the adjustment chamber 602 to be screwed up or down so as to finely adjust the height of the foundation plate 606. In some embodiments, the foundation 300 may have a plurality of adjustment bars 604 so as to finely adjust the tilt of the foundation plate 606. Therefore, a column 200 comprising a connector plate 1006 having bar holes 608 may be set on top of the foundation plate 606 with the bar holes 608 of the connector plate 1006 aligning with the bar holes 608 of the foundation plate 606 so that the adjustment bar 604 passes through both the foundation plate 606 and the connector plate 1006.

Once all the columns 200 of the first frame module 102 are fitted on to a foundation plate 606, an adjacent frame module 102 may be properly aligned by rotating the nuts 610 accordingly until the preferred level and alignment are achieved. Once the preferred level and alignment are achieved the adjustment chamber 602 may be filled with a solidifying material such as cement or grout, preferably, non-shrink grout to secure the height of the foundation plate 606. The foundation plate 606 and the connector plate 1006 can further be welded together to secure the connection between the connector plate 1006 and the foundation plate 606. Once the connector plate 1006 and foundation plate 606 are secured, the portions of the adjustment bars 604 that protrude out beyond the connector plate 1006 may be cut off by standard means. To allow for more precision in the alignment process, as well as greater foundational stability, a plurality of bases 600 may be placed along the beam 202, intermittently spaced. Alternatively, a single foundation 300 may expand the length of a beam 202, with a plurality of adjustment chambers 602, adjustment bars 604, and foundation plates 606 with bar holes 608, intermittently spaced around the foundation 300.

Figure 7A:
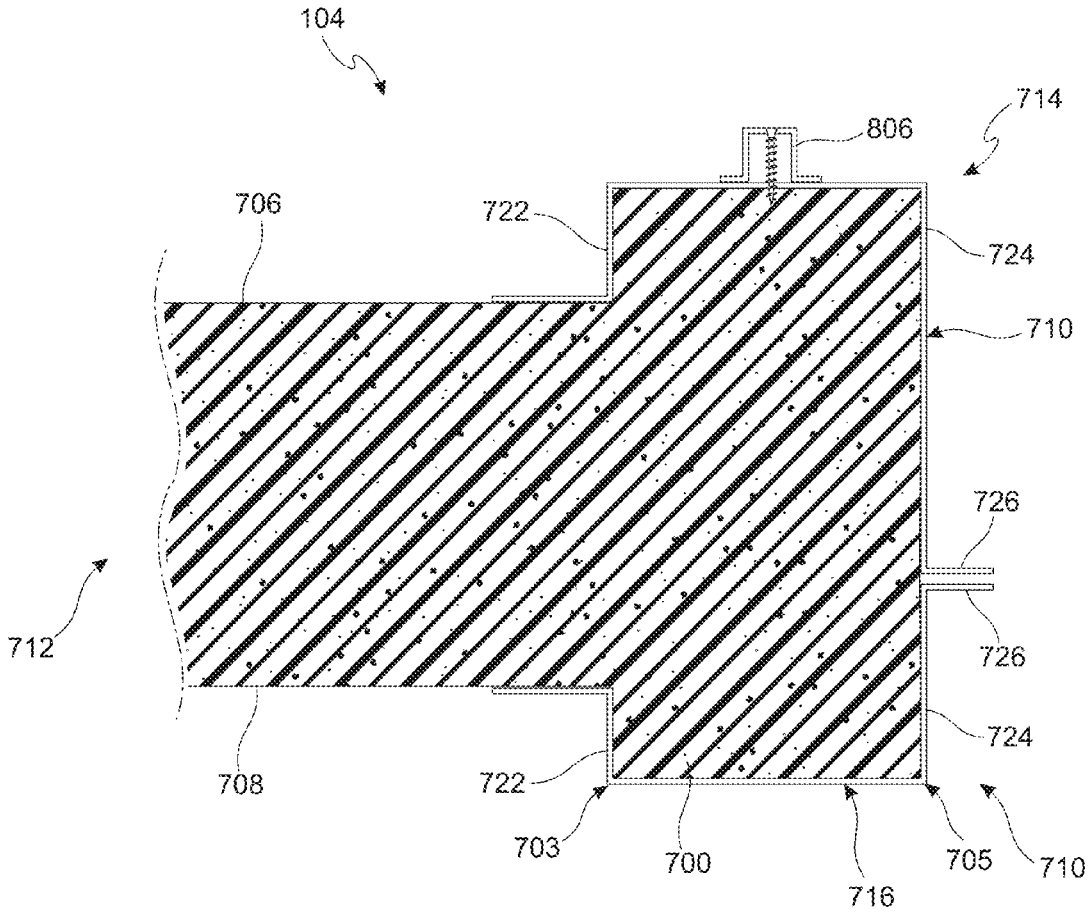
FIG. 7A is a top view of a cross-section of an embodiment of a portion of a panel of the present invention.
Figure 7B:
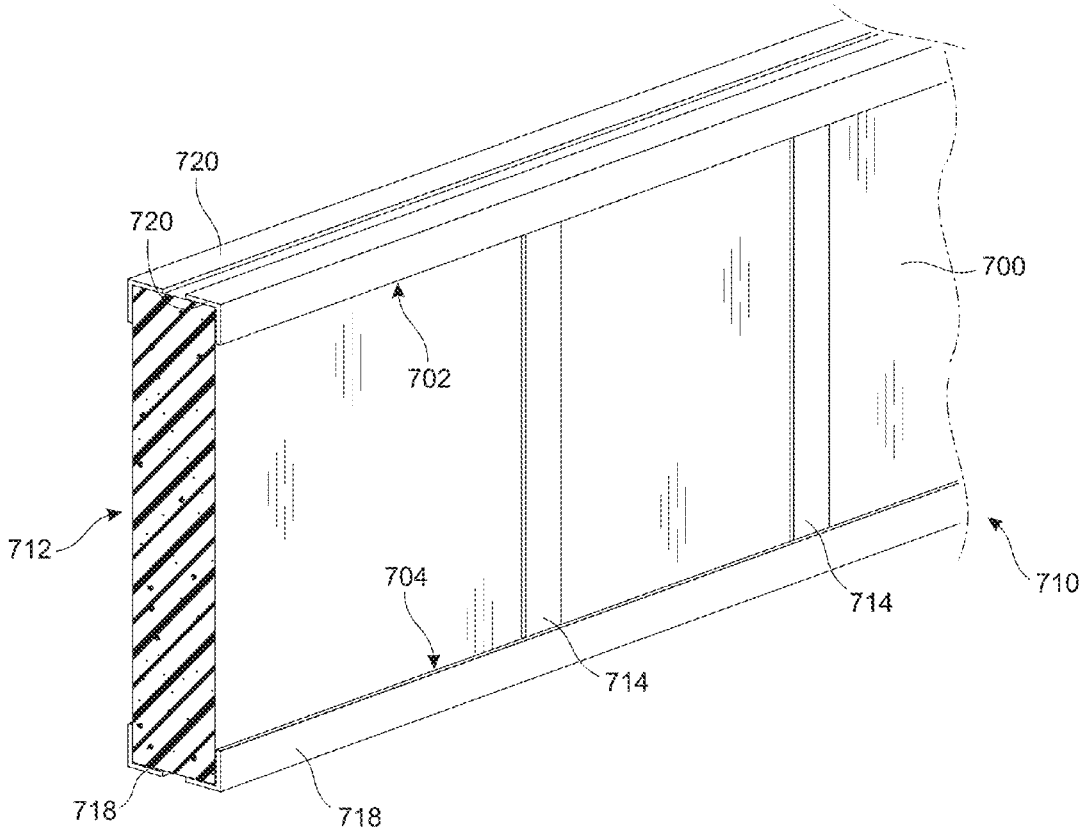
FIG. 7B is a side view of a portion of an embodiment of the panel of the present invention.

Once a first frame module 102 has been secured to the foundation 300, panels 104, 106, 108, and/or 110 may be installed, or additional frame modules 102 may be connected, to the first frame module 102. By way of example and not limitation, the entire wall system of a home constructed in accordance with the present invention may be comprised of structural insulated panels (SIP), which comprise light gauge recycled metal and expanded polystyrene ("EPS") foam, preferably EPS manufactured by BASF due to its highest content of regrind. Briefly, as shown in FIG. 7, the wall panel has a top end 702, a first end 710 adjacent to the top end 702, a second end 712 adjacent to the top end 702 and opposite the first end 710, and a bottom end 704 adjacent to the first and second ends 710, 712 and opposite the top end 702, wherein the top end 702, the first and second ends 710, 712, and the bottom end 704 define a first side 706 and a second side 708 opposite the first side 706.

The wall panel 104 further comprises an insulator 700, preferably made of EPS core, supported by plurality of paired elongated studs 714, 716 on opposite sides of the insulator, intermittently spaced along the insulator, each pair of elongated studs extending longitudinally from the bottom end 704 of the insulator to the top end 702 of the insulator with the insulator positioned substantially between the pairs of elongated studs 714, 716. The elongated studs 714, 716 and insulator 700 are also positioned or sandwiched between two pairs of angles 718, 720, the first angle pair 718 extending from a first end 710 of the insulator 700 to a second end 712 of the insulator 700 along the bottom end 704, wherein the first pair of angles at least partially cover the first and second sides at the bottom end, and the second pair 720 extending from the first end 710 to the second end 712 of the insulator 700 along the top end 702, wherein the second pair of angles at least partially cover the first and second sides at the top end. A waterproofing membrane 906 can be used to seal a panel 104.

Figure 8A:
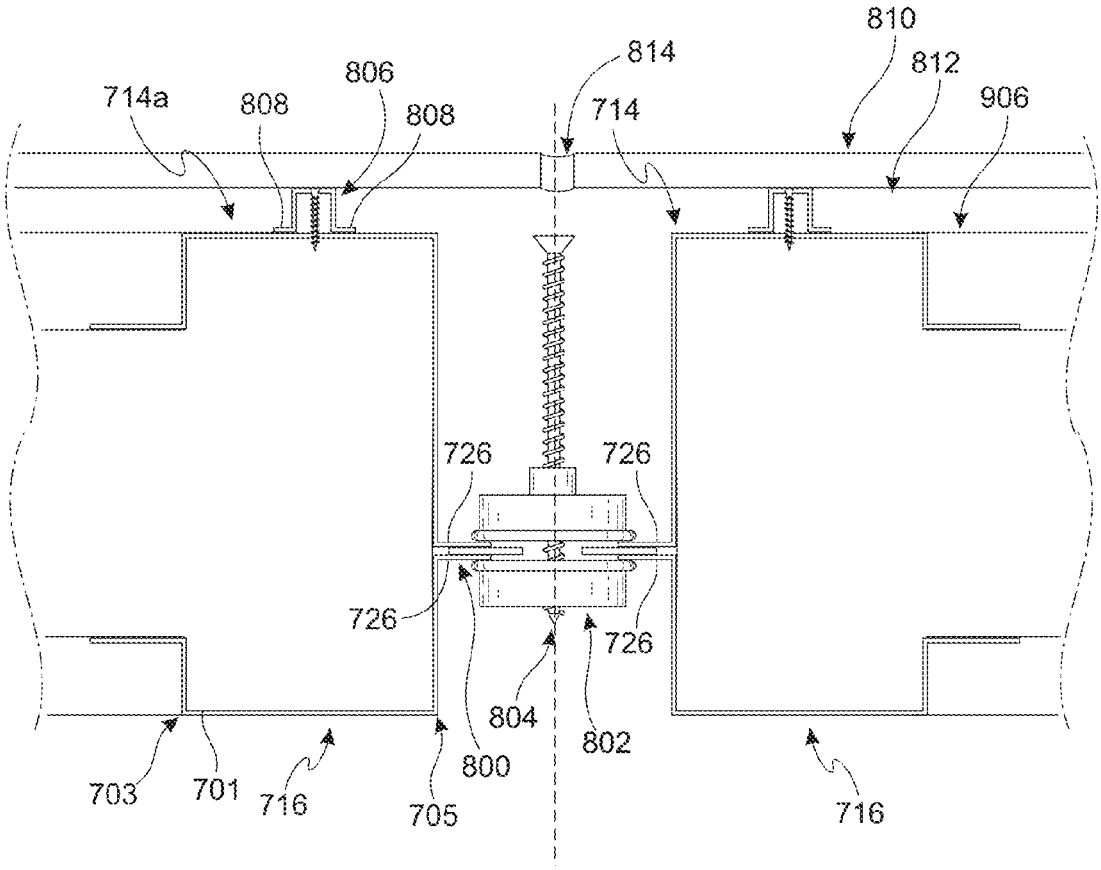
FIG. 8A is a top view of a connection between two panels of the present invention with the insulator removed.

The elongated studs 714, 716 and angles 718, 720 are made of sheet metal formed to fit the insulator 700. Each angle 718, 720 is generally "L" shaped and partially covers either the top or the bottom and one side. Each elongated stud 714, 716 is generally "L"—or "U"-shaped with a medial bend 722 and a lateral bend 724 embedded within the insulator 700 to secure the elongated studs 714, 716 on to the insulator 700. The end unit studs or the studs located at the first and second ends 710, 712 of the insulator 700 may have an additional flange 726 protruding from the lateral arm 724 at right angles. In addition, the lateral bend 724 of an end unit elongated stud may not be embedded within the insulator 700 as shown in FIG. 7A. The flange 726 of a first elongated stud 714 aligns parallel with the flange 726 of a second elongated stud 716 opposite the first elongated stud 714 and fastens to each other and to an adjacent pair of end unit elongated studs. This allows adjacent panels to fasten to each other as shown in FIG. 8A. To maintain weatherproofing of connected panels, a thermo-break gasket 800 is inserted between the flange 726 of all elongated stud pairs 714, 716 prior to securing the pair of elongated studs 714, 716 together.

As shown in FIG. 8A, adjacent pairs of elongated studs 714*a*, 714*b*, 716*a*, 716*b* of two different panels may be fastened together at the flanges 726 of the end unit elongated studs with a compression gasket 802. A screw 804, nut and bolt, or some other reversible connector, compresses the compression gasket 802 against flanges 726 creating a tight seal between the compression gasket 802 and the flanges 726. This increases the seal created between the flanges 726 and the thermo-break gaskets 800 as well. Because the compression gasket 802 and the thermo-break gasket 800 are poor conductors of heat and the insulator 700 is also a poor conductor of heat, the temperature on one side 706 of the panel 104 (i.e. the outside) will not readily transfer to the other side 708 (inside) of the panel, thereby minimizing the transference of heat or cold from the outside of the building to the inside of the building.

Figure 8B:
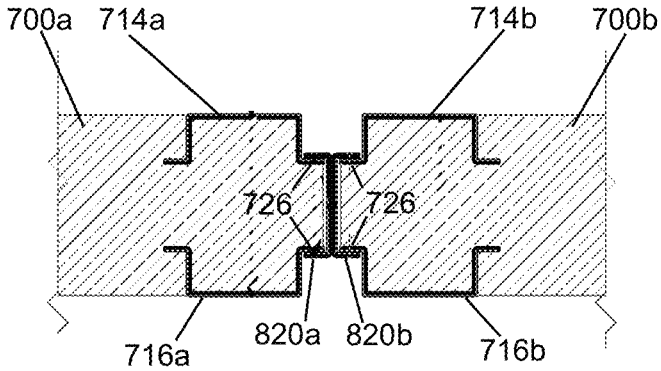
FIG. 8B is a top view of another connection between two panels of the present invention.
Figure 8C:
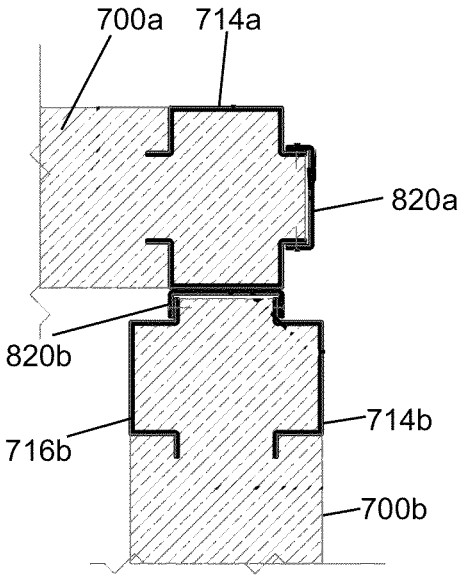
FIG. 8C is a top view of another connection between two panels of the present invention.

In some embodiments, the adjacent wall panels 104 may be connected to each other by other means besides the compression gasket 802. For example, an end cap 820 may be used to cap or enclose a pair of adjacent flanges 726 of an insulator 700 as shown in FIGS. 8B and 8C. The end cap 820 is generally "U"-shaped. In other words, end cap 820 comprises a flat surface 821 that terminates with its ends 822, 824 bending at substantially right angles so that the ends 822, 824 form flanges 826, 828 that are generally parallel to each other. These flanges 826, 828 define a gap that is sufficiently wide so as to be fastenable to the flanges 726 of the elongated studs 714, 716. Two insulators 700*a* and 700*b* capped with these end caps 820 can now be placed adjacent to each other, end-to-end, with the flat surface of one end cap 820*a* directly in contact and flush with the flat surface of another end cap 820*b*. These end caps 820*a*, 820*b* may be fastenable to each other.

Figure 8E:
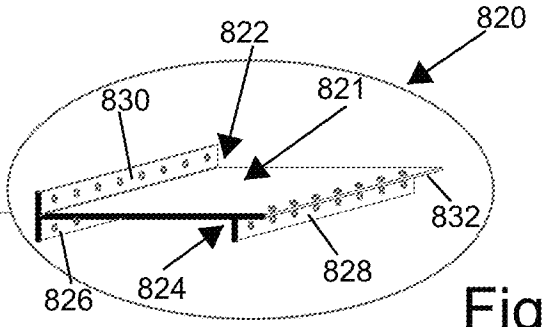
FIG. 8E is a perspective view of an embodiment of an end cap used to connect adjacent panels.

In some embodiments, one end 822 of the end cap 820 may further comprise a second flange portion 830, while the second end 824 comprises an extension portion 832 that extends beyond the flange 828 as shown in FIG. 8E.

Figure 8D:
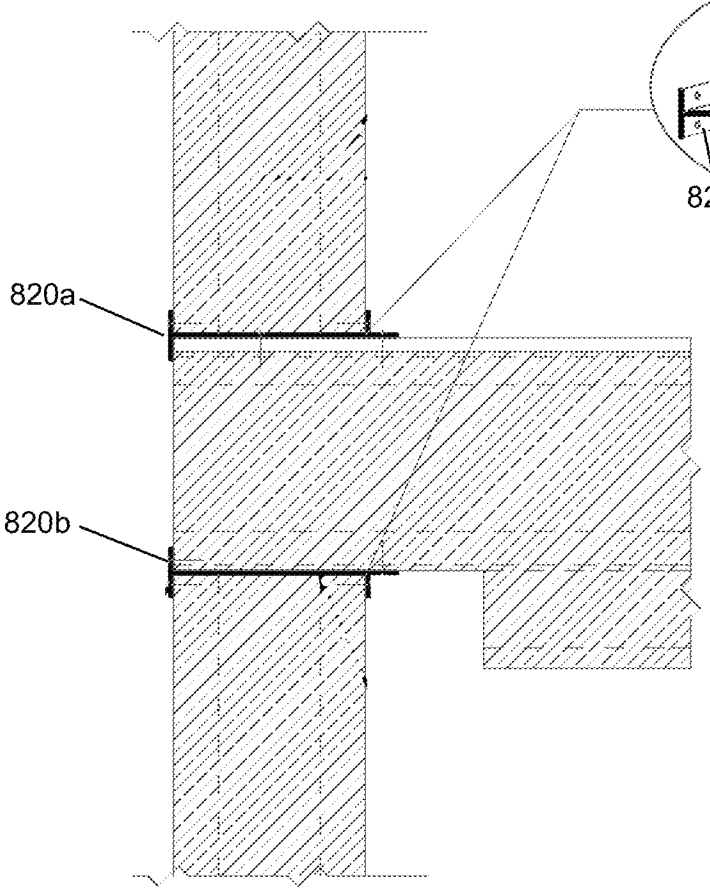
FIG. 8D is a top view of another connection between two panels of the present invention.

Utilizing end caps 820 also allows the first insulator 700*a* to be connected to a second insulator 700*b* at right angles. Due to the flat surface provided by the end cap 820, the end cap 820 can make a direct and flush contact with the flat, exposed portion of an elongated stud 714 or 716 as shown in FIGS. 8B and 8C. In some embodiments, the end caps 820 may be used alone as a substitute for the elongated studs 714, 716. In such embodiments, the gap between the flanges 826, 828 of the end caps 820 may be sufficiently wide so as to be capable of enclosing the width of an insulator 700 as shown in FIG. 8D.

To further improve weatherproofing of the wall panels 104, the elongated studs 714 nearest the outside of the building may further comprise a hat channel 806. The hat channel 806 is a piece of sheet metal formed in the shape of a "top hat." The rim 808 of the hat channel 806 is fastened to the elongated stud 714. A concrete wall 810 may be erected and attached to the elongated stud 714 via the hat channel. Due to the hat channel 806, an air gap 812 is created between the concrete wall 810 and the elongated studs 714 to further reduce the amount of heat or cold transferred from the outside to the inside. The concrete walls 810 may further comprise holes 814 strategically placed, through which the screw 804 can be tightened to compress the compression gasket 802.

Figure 19:
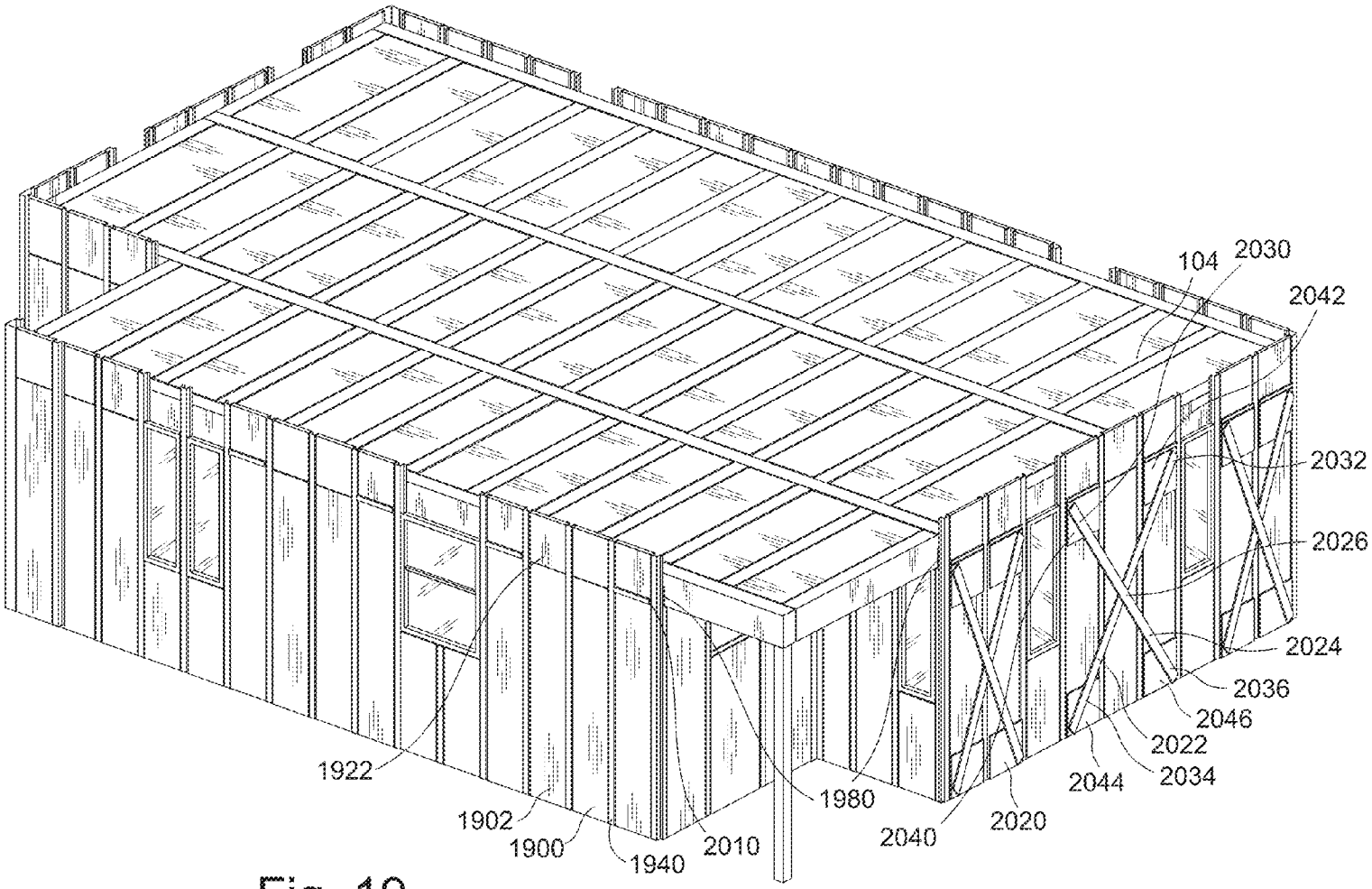
FIG. 19 is an embodiment of a building utilizing an improved wall panel of the present invention with some of the auxiliary panels removed for clarity.

FIG. 19 shows an alternate embodiment of an improved wall panel 1900. The wall panel 1900 is configured for quick and easy installation and combination with a ceiling section 106. The wall panel 1900 may comprise a main wall section 1902, an auxiliary wall section 1922, and two sets of elongated studs 1940, 1960 to provide structural integrity to the wall panel 1900. Each elongated stud in the first set of elongated studs 1940 is longer than each elongated stud in the second set of elongated studs 1960. In addition, the length of the elongated studs in the first set of elongated studs 1940 is greater than the height H1 of the main wall section 1902. The main wall section 1902 attaches to the foundation and the auxiliary wall section 1922 attaches to the top of the main wall section 1902 to determine the final height of the wall panel 1900.

The main wall section 1902 has a top 1904, a bottom 1906 opposite the top 1904, a first side 1908 adjacent to the top 1904 and the bottom 1906, a second side 1910 opposite the first side 1908 and adjacent to the top 1904 and the bottom 1906, an inside-facing surface 1912 bound by the top 1904, bottom 1906, first side 1908, and second side 1910, and an outside-facing surface 1914 opposite the inside-facing surface 1912, the outside-facing surface 1914 bound by the top 1904, bottom 1906, first side 1908, and second side 1910. The main wall section has a height H1 measured from the top 1904 to the bottom 1906, a width W1 measured from the first side 1908 to the second side 1910, and a thickness T1 measured from the inside-facing surface 1912 to the outside-facing surface 1914.

Like the main wall section 1902, the auxiliary wall section 1922 comprises a top 1924, a bottom 1926 opposite the top 1924, a first side 1928 adjacent to the top 1924 and the bottom 1926, a second side 1930 opposite the first side 1928 and adjacent to the top 1924 and the bottom 1926, an inside-facing surface 1932 bound by the top 1924, bottom 1926, first side 1928, and second edge 1930, and an outside-facing surface 1934 opposite the inside-facing surface 1932, the outside-facing surface 1934 bound by the top 1924, bottom 1926, first side 1928, and second side 1930. The auxiliary wall section 1922 has a height H2 measured from the top 1924 to the bottom 1926, a width W2 measured from the first side 1928 to the second side 1930, and a thickness T2 measured from the inside-facing surface 1932 to the outside-facing surface 1934.

The heights of the main wall section 1902 and the auxiliary wall section 1922 may vary so that any size wall panel can be created by mixing and matching specific size main and auxiliary wall sections 1902, 1922. For simplicity and ease in the manufacturing process, the main wall section 1902 and the auxiliary wall section 1922 may come in a set standard size. By way of example, only, the wall panels 1900 may come in three sizes, 3 feet long, 4 feet long, or 8 feet long. Each of these three sizes may have a height that ranges from 3 feet to 5 feet. In one embodiment, the height of each panel may be 3.7 feet. In another embodiment, the height may be 4.7 feet. Using these dimensions, a panel of a variety of useful sizes can be created.

A first or long set of elongated studs 1940 is embedded in the outside-facing surface 1914 of the main wall section 1902. Each long elongated stud is typical of elongated studs in the industry. By way of example only, the long elongated stud 1940 may be a hat channel, having a length, width, and thickness. The hat channel is defined by a flat base 1942 having to opposing ends 1944, 1946. Projecting perpendicularly to the base 1942 from each of the opposing ends 1944, 1946 are sides may 1948, 1950. The free ends of the sides 1948, 1950 each have a flange 1952, 1954 projecting outwardly and perpendicularly to the sides 1948, 1950. Thus, the flanges 1952, 1954 are parallel to the base 1942. The width of the elongated stud 1940 is the distance from the free end of the first flange 1952 to the free end of the second flange 1954. The thickness of the elongated stud 1940 is the shortest distance between the base 1942 and a plane defined by the flanges 1952, 1954. The thickness of the elongated stud 1940 is smaller than the thickness T1 of the main wall section 1902. The elongated studs may also be a C-channel with the flanges pointed inward. For corners, corner studs may be used. The corner stud is essentially identical with a long elongated stud except that one of the flanges 1954 projects inwardly towards the other flange 1952 so as to be underneath the base 1942, while the other flange 1952 projects outwardly, creating a smooth, flat side at the corner. Other types of studs known in the art can be used.

Figure 20A:
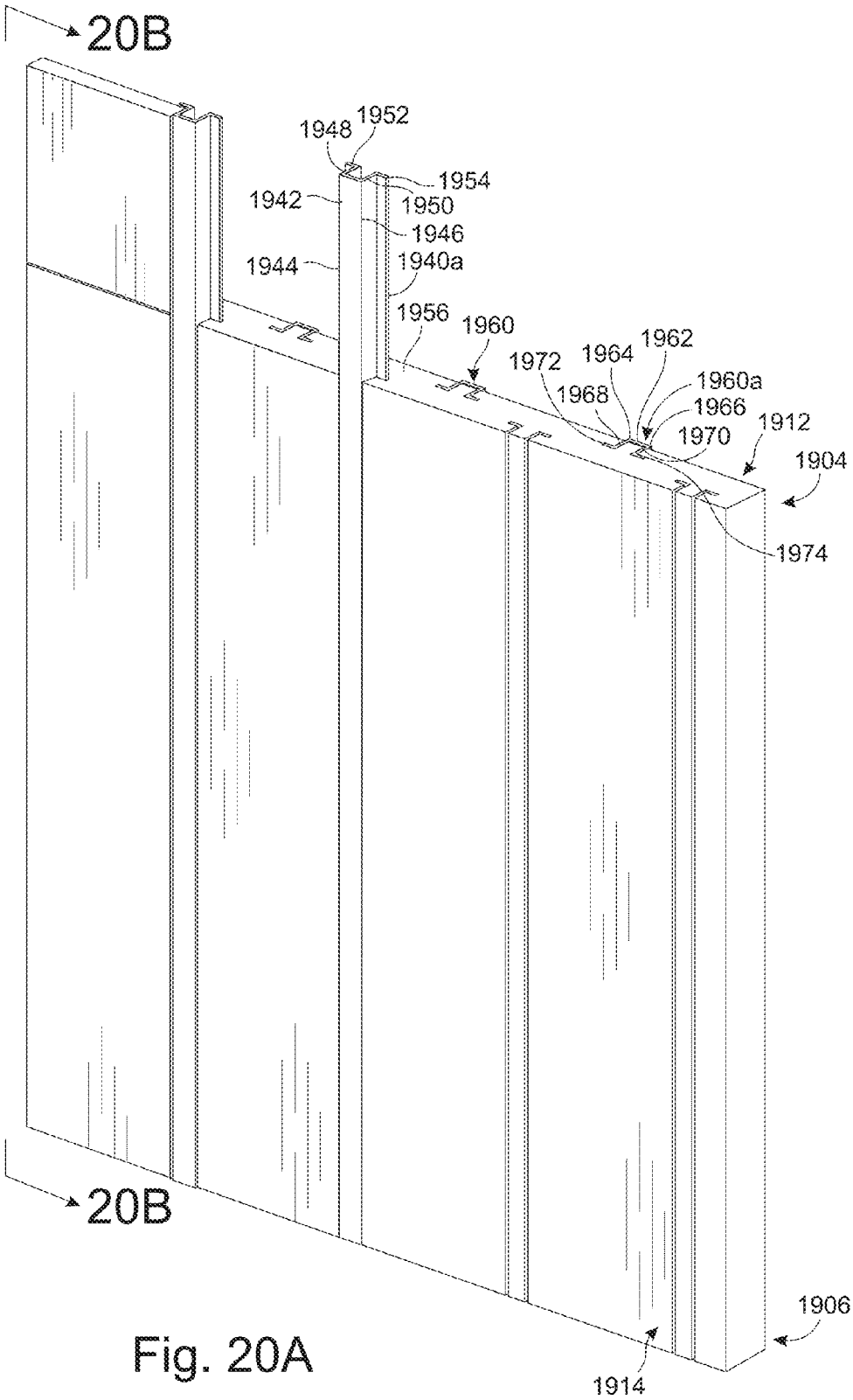
FIG. 20A is a perspective view of an embodiment of an improved wall panel showing the outside-facing surface.
Figure 20B:
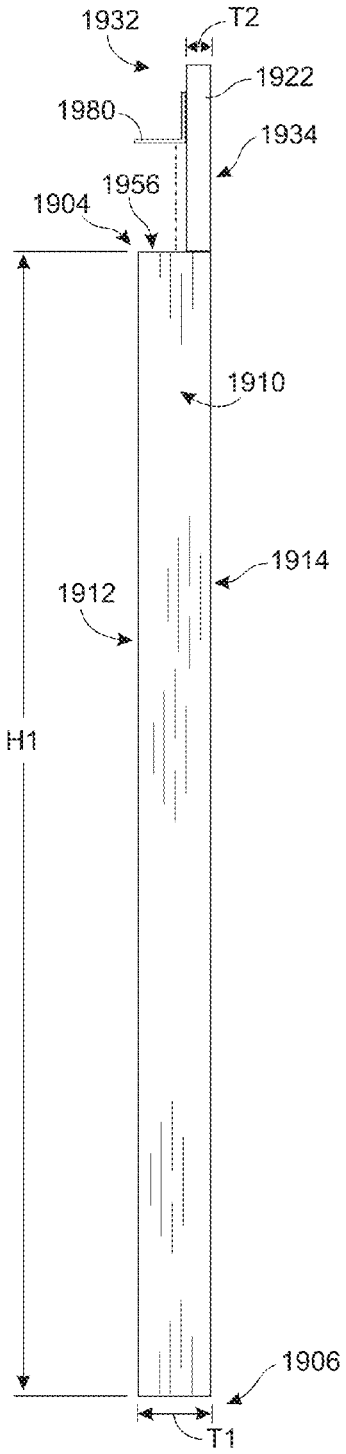
FIG. 20B is a side view of an improved wall panel.
Figure 20C:
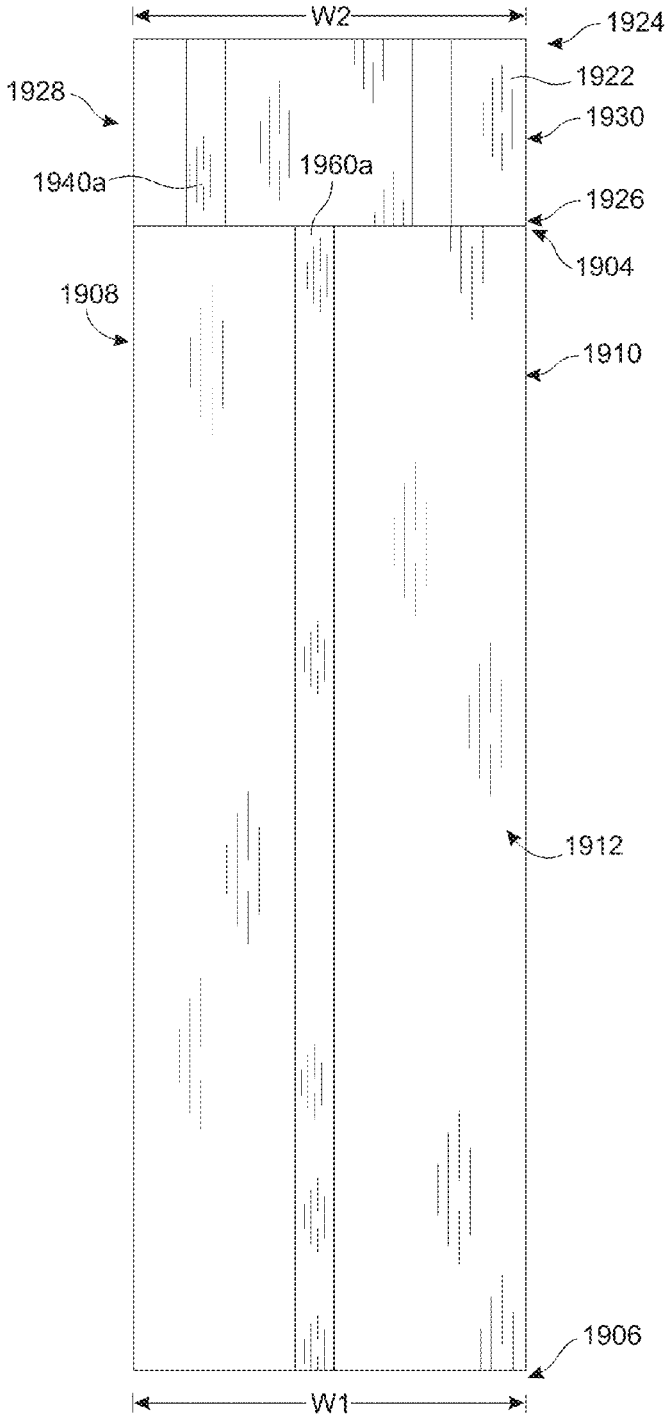
FIG. 20C is an elevation view of the inside-facing surface of the improved wall panel.
Figure 20D:
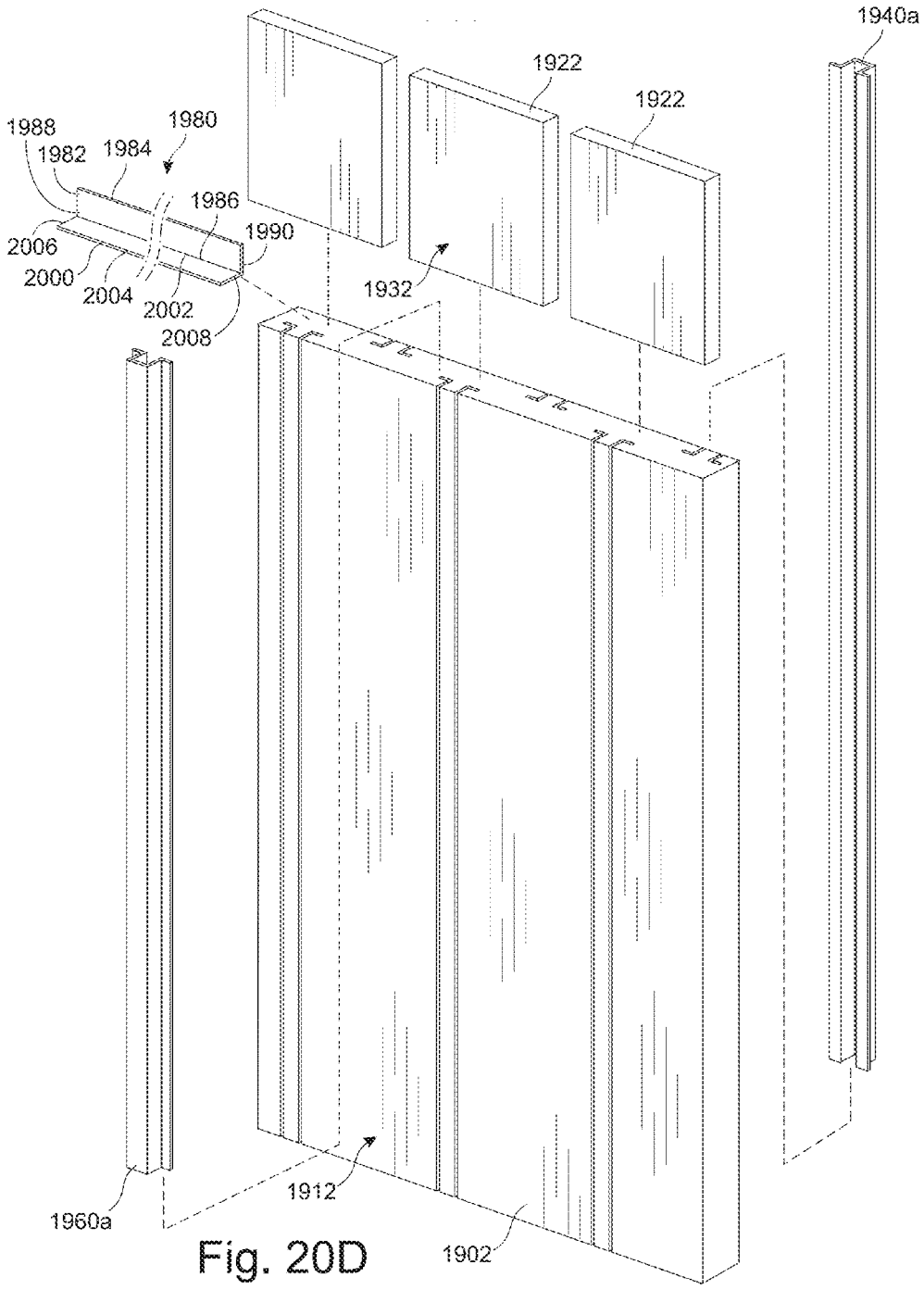
FIG. 20D is an exploded view of the improved wall panel of the present invention.

The long elongated stud 1940*a* is embedded into the main wall section 1902 such that the flat base 1942 of the elongated stud is substantially flush with the outside facing surface 1914 of the main wall section 1902. Since the length of the long elongated stud 1940*a* is greater than the height H1 of the main wall section 1902, a portion of the elongated stud 1940*a* projects above and beyond the top 1904 of the main wall section 1902 as show in FIG. 20A. Since the thickness T1 of the main wall section 1902 is greater than the thickness of the elongated stud 1940*a* the flanges 1952, 1954 reside in between the outside facing surface 1914 and the inside facing surface 1912 of the main wall section 1902. With a portion of the long elongated stud 1940*a* projecting above the top 1904 of the main wall section 1902 a ledge 1956 is created with the portion of the long elongated studs 1940 creating a barrier. When multiple wall panels are arranged together, for example, to form a box, all ledges 1956 form inwardly, while all the long elongated studs 1940*a* are on the outer side. This allows a ceiling 106 to be placed on the ledge 1956 with the first set of elongated studs 1940 forming a barrier surrounding the ceiling to prevent ceiling from sliding around or falling off.

A second or short set of elongated studs 1960 is embedded in the inside-facing surface 1912 of the main wall section 1902. The terms "long" and "short" with reference to the elongated studs are relative terms to characterize the length of the elongated studs relative to each other and not to indicate a specific length. Each short elongated stud 1960*a* in the short set of the elongated studs 1960 is typical of elongated studs used or wall panels, such as have channels. In one embodiment, the long set of elongated studs 1940 and the short set of elongated studs 1960 are virtually identical except as to length. Therefore, each short elongated stud 1960*a* in the short set of elongated studs 1960 comprises a flat base 1962, opposing ends 1964, 1966, sides 1968, 1970 projecting from the opposing ends 1964, 1966 perpendicularly to the flat base 1962, and flanges 1972, 1974 projecting from the sides 1968, 1970 and perpendicularly to the sides 1968, 1970 much like the long set of elongated studs 1940. The width of the short elongated stud 1960*a* is the distance from the free end of the first flange 1972 to the free end of the second flange 1974. The thickness of the short elongated stud 1960 is the shortest distance between the base 1962 and a plane defined by the flanges 1972, 1974. The thickness of the short elongated stud 1960*a* is smaller than the thickness of the main wall section 1902.

The short set of elongated studs 1960 are embedded in the inside-facing surface 1912 of the main wall section 1902 so that the flat base 1962 is substantially flush with the inside-facing surface 1912. Since the thickness of the short elongated stud 1960*a* is smaller than the thickness of the main wall section 1902, the flanges 1972, 1974 remain embedded in between the inside-facing surface 1912 and the outside-facing surface 1914. In the preferred embodiment, the length of the short elongated stud 1960*a* is substantially the same as the height H1 of the main wall section 1902. This gives the main wall section 1902 increased stability and integrity when a load is applied to the main wall section 1902, such as a ceiling 106.

In the preferred embodiment, the thickness T2 of the auxiliary wall section 1922 may be smaller than the thickness T1 of the main wall section 1902. This allows the auxiliary wall section 1922 to fit completely on the main wall section 1902. In some embodiments, the auxiliary wall section 1922 may have substantially the same thickness as the long elongated studs 1940*a*. This allows the auxiliary wall section 1922 to be positioned on top of the main wall section 1902 and adjacent to a long elongated stud 1940*a* and abutted against one of the sides 1948. A second auxiliary wall section 1922 may be positioned on top of the main wall section 1902 on the opposite side 1950 of the long elongated stud 1940*a*. Since the auxiliary wall sections 1922 are substantially the same thickness as the long elongated stud 1940*a*, the inside-facing surfaces 1932 of the auxiliary wall sections 1922 will abut the flanges 1952, 1954 while the outside-facing surfaces are flush with the flat base 1942. From the outside, the wall panel 1900 will have the appearance of being a single smooth panel.

The wall panel 1900 may further comprise an L-shaped angle 1980. The L-shaped angle 1980 may have a vertical section 1982 and a horizontal section 2000. The vertical section 1982 is generally rectangular in shape defined by a first long edge 1984, a second long edge 1986 opposite the first long edge 1984, a first short edge 1988 adjacent to the first long edge 1984 and the second long edge 1986, and a second short edge 1990 opposite the first short edge 1988 and adjacent to the first long edge 1984 and the second long edge 1986.

The horizontal section 2000 is generally rectangular in shape defined by a first long edge 2002, a second long edge 2004 opposite the first long edge 2002, a first short edge 2006 adjacent to the first long edge 2002 and the second long edge 2004, and a second short edge 2008 opposite the first short edge 2006 and adjacent to the first long edge 2002 and the second long edge 2004. The vertical section 1982 and the horizontal section 2000 are generally perpendicular to each other and the second long edge 1986 of the vertical section 1982 is attached to the first long edge 2002 of the horizontal section 2000. The horizontal section 2000 is positioned on the ledge 1956 of the main wall section 1902 with the vertical section 1982 abutted against the flanges 1952 of the first set of elongated studs 1940. This provides enhanced stability to a ceiling panel that can be placed within the L-shaped angle 1980.

In some embodiments, the wall panel 1900 may further comprise a spacer 2010 positioned in between the main wall section 1902 and the auxiliary wall section 1922 to adjust the total height of the wall panel 1900 and increase the variability of the height of the wall panel. For example, the spacer 2010 may have a height of half a foot to allow the wall panel 1900 to increase in height by half a foot increments.

In some embodiments, the wall panel 1900 may further comprise a cross brace 2020 attached to outside-facing surface 1914 of the main wall section 1902 and the outside-facing surface 1934 of the auxiliary wall section 1922. The cross brace 2020 may comprise two flat, elongated members 2022, 2024 attached to each other at their centers 2026 in such a way as to form an "X"-shaped configuration, thereby leaving terminal ends 2030, 2032, 2034, 2036. In some embodiments, the terminal ends 2030, 2032, 2034, 2036 may each be connected to a rectangular or square plate 2040, 2042, 2044, 2046 that is fastened to the outside-facing surfaces 1914, 1934 of the main wall section 1902 and the auxiliary wall section 1922.

Figure 9A:
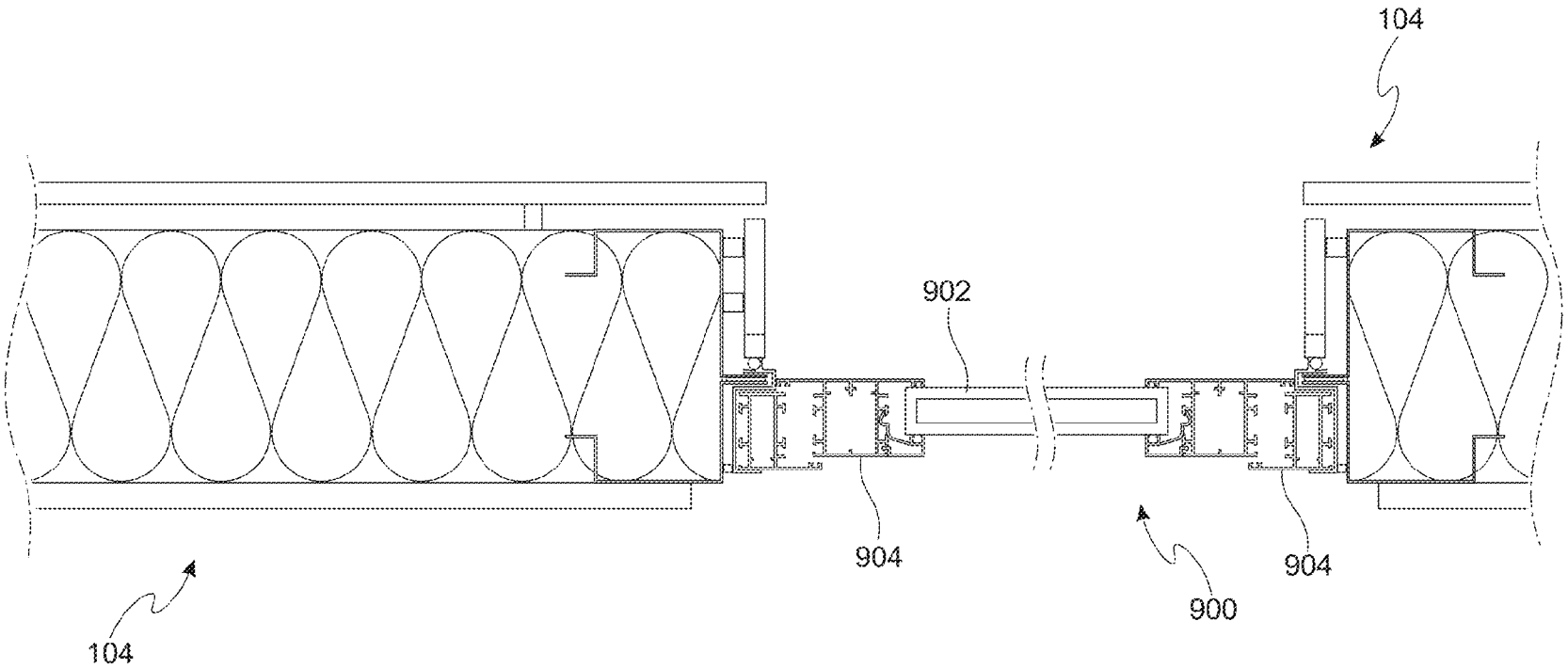
FIG. 9A is a top view of a cross-section of a wall panel attached to a window panel of the present invention.
Figure 9B:
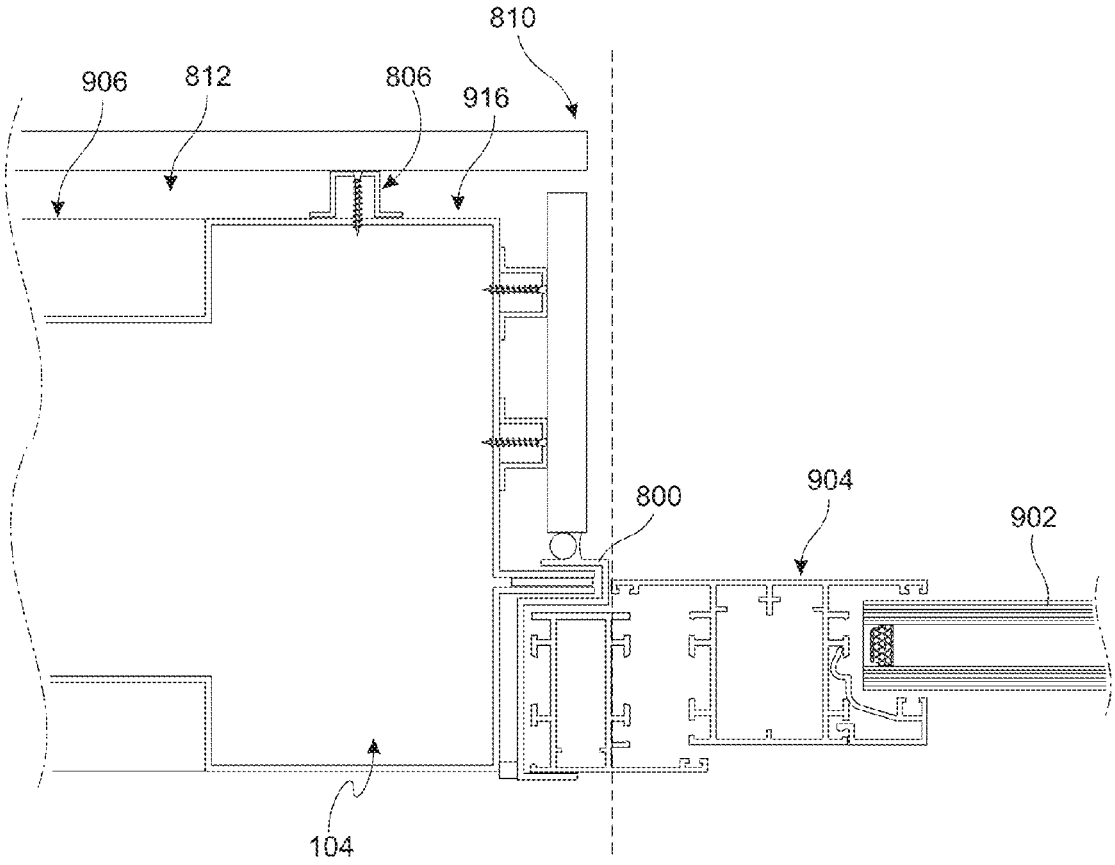
FIG. 9B is a close-up view of FIG. 9A at the wall panel/window panel junction.

As shown in FIGS. 9A and 9B, window panels 900 and sliding glass doors may be similarly attached to the wall panels 104. A window panel 900 comprises a glass 902 and a glass frame 904. The glass frame 904 may be connected to the end unit elongated stud 716 via a thermo-break gasket 800. Windows may be of the type sold by Metal Window Corporation, but are not limited thereto.

The insulation 700 in the wall panels 104 may comprise channels 1000 through which electrical wiring 1002 and plumbing pipes may run, including preinstalled outlets 1004. This reduces the time required to wire the building 100 and hook up the pipes.

Figure 10:
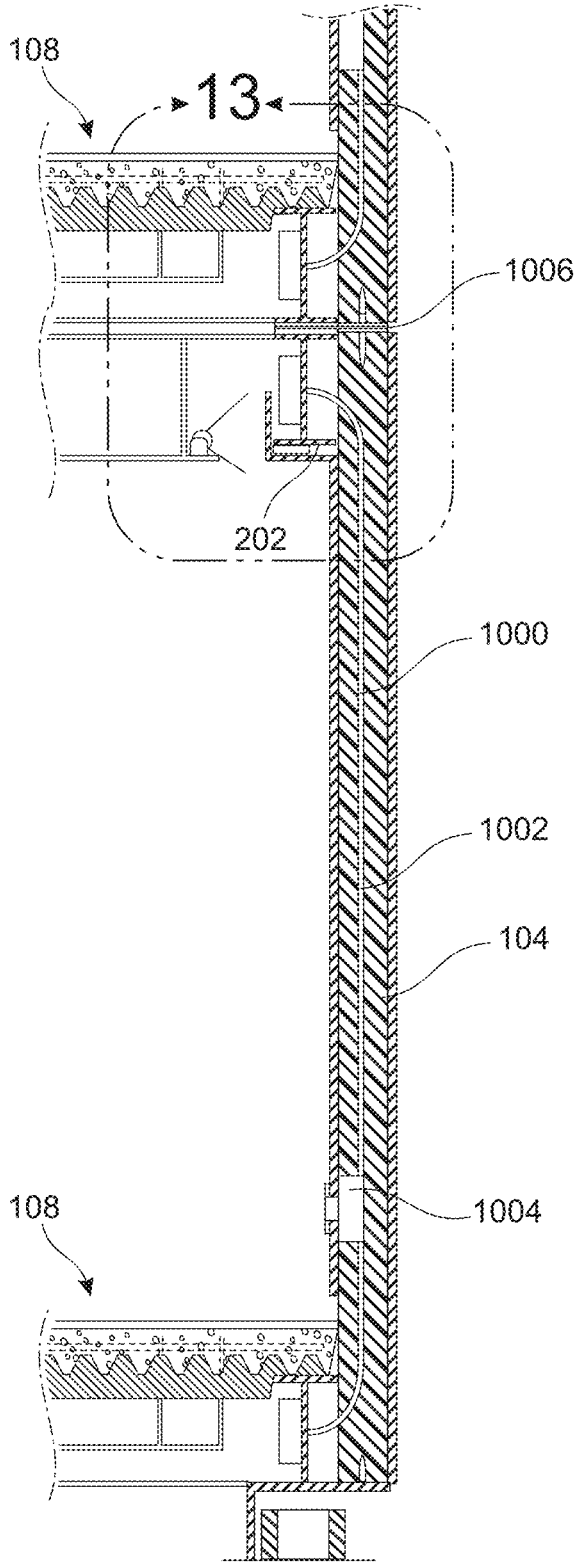
FIG. 10 is a side view of a cross-section of a wall panel of the present invention.
Figure 11:
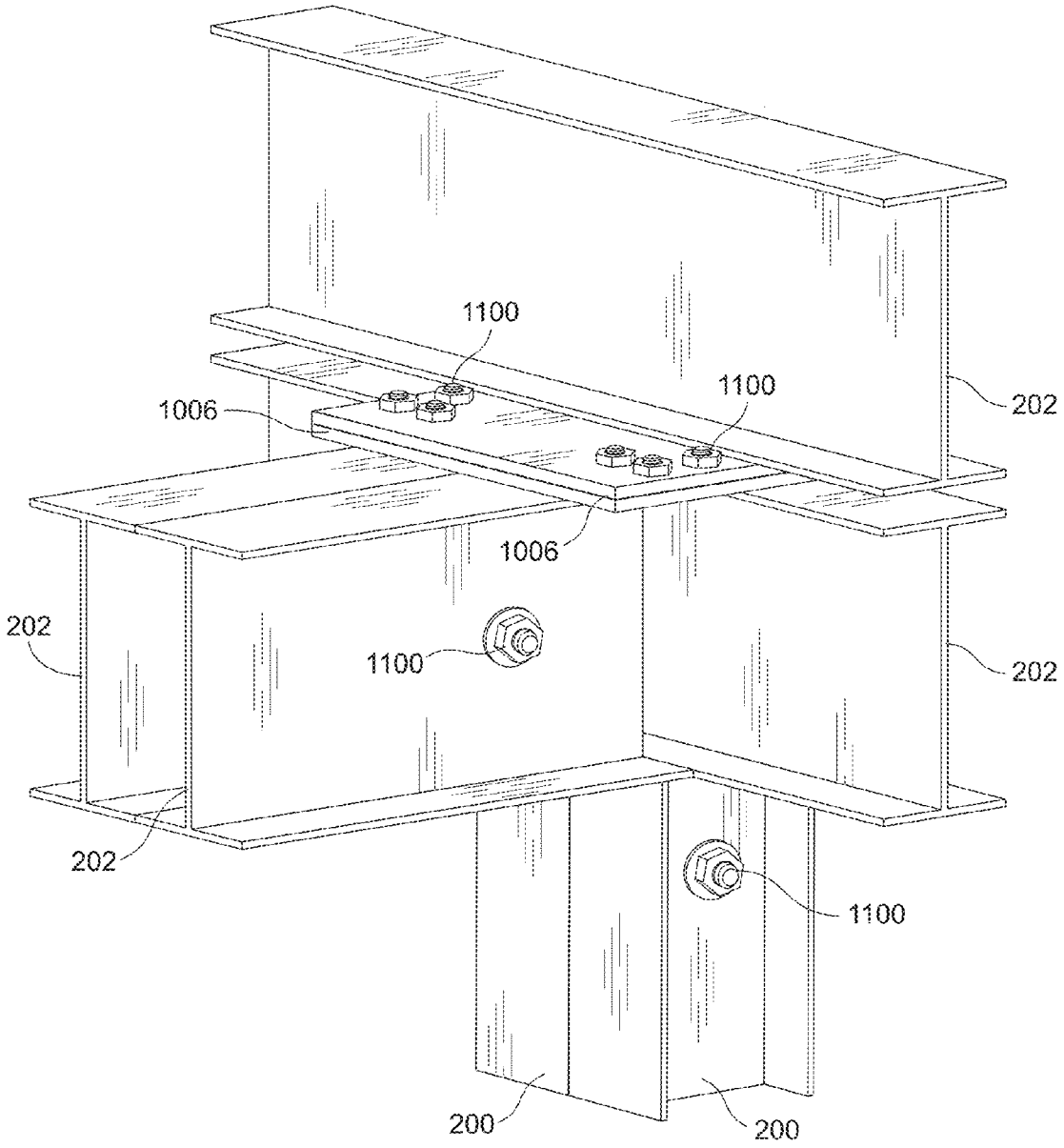
FIG. 11 is a perspective view of a connection of a frame module of the present invention.
Figure 12:
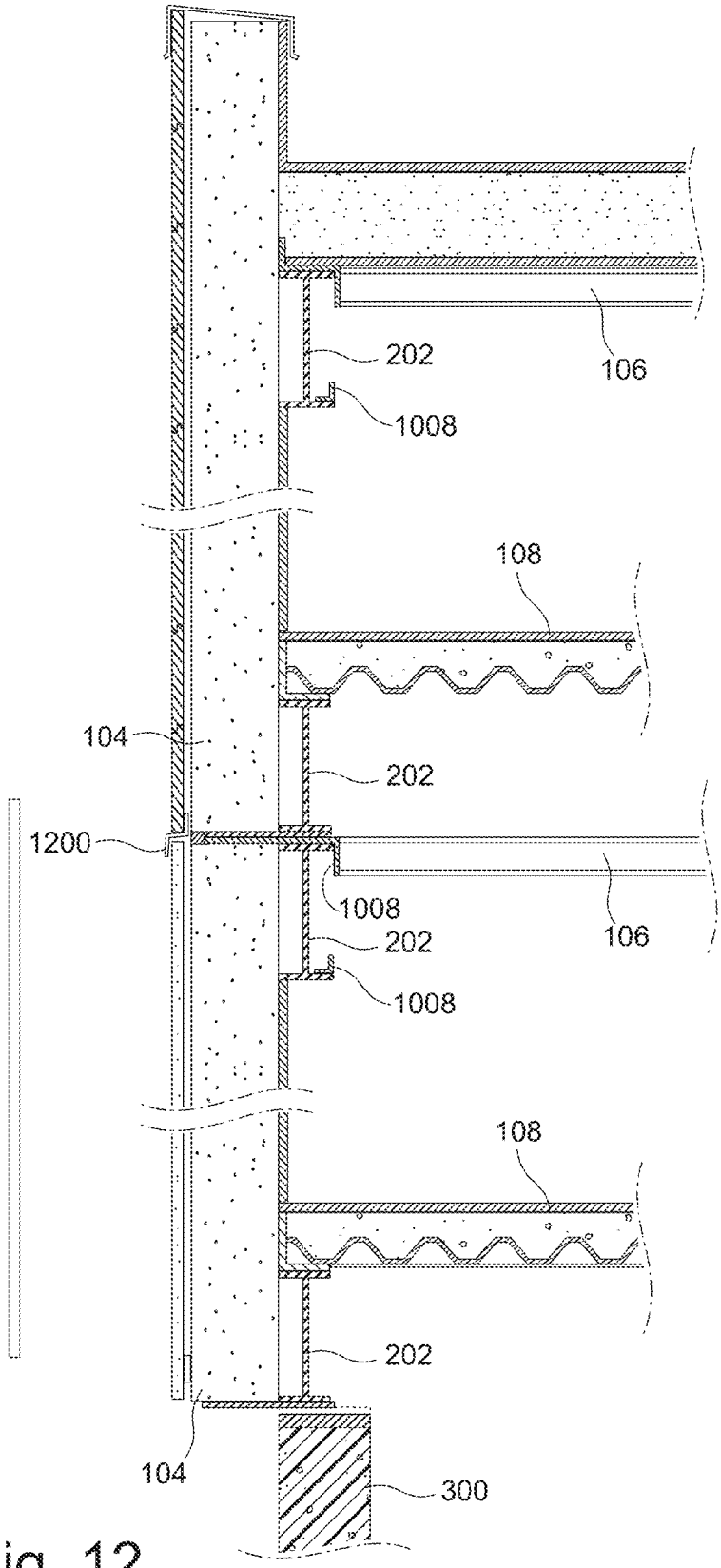
FIG. 12 is a partial elevation view of a cross-section of the present invention.

As shown in FIG. 10, the frames and frame modules 102 may be connected to each other via flat connector plates 1006. Beams 202 may be connected to other beams 202, columns 200 may be connected to other columns 200, and beams 202 may be connected to columns 200 via the connector plates 1006 as shown in FIG. 11. Preferably, the frames are connected to the connector plates with reversible connectors 1100, such as nuts and bolts or nails, for quick construction and destruction. As shown in FIG. 12, the connector plates 1006 may further comprise an "L" shaped bend 1008 to which a floor panel 108 and a ceiling panel 106 may be attached. Alternatively, the floor panels 108 and ceiling panels 106 may be attached directly to a beam 202.

The connector plates 1006 are adaptable for use in structural, waterproofing, electrical, and plumbing connections. The entire space between the connector plates 1006 are sealed by a vibration dampening pad 1306. The vibration dampening pads 1306 are recycled rubber material with a special adhesive that connects the flat connector plates 1006 to the vibration dampening pad 1306. The vibration dampening pad 1306 thickness exceeds the total dimensions of the connector plates 1006. Once the frame modules 102 are placed at the construction site, the connector plates 1006 are sealed seamlessly due to the compressive weight of the frame module 102 with minimal added sealant connections. In addition, reversible clamp connections, such as nuts and bolts, are designed to create simple, reliable, tight connections.

In some embodiments, weather-stripping and/or magnetic gaskets may be used. Flexible magnets may also be used to attach and connect parts such as lighting fixtures, ceiling materials decorative panels, etc. to the steel frame module.

Figure 13:
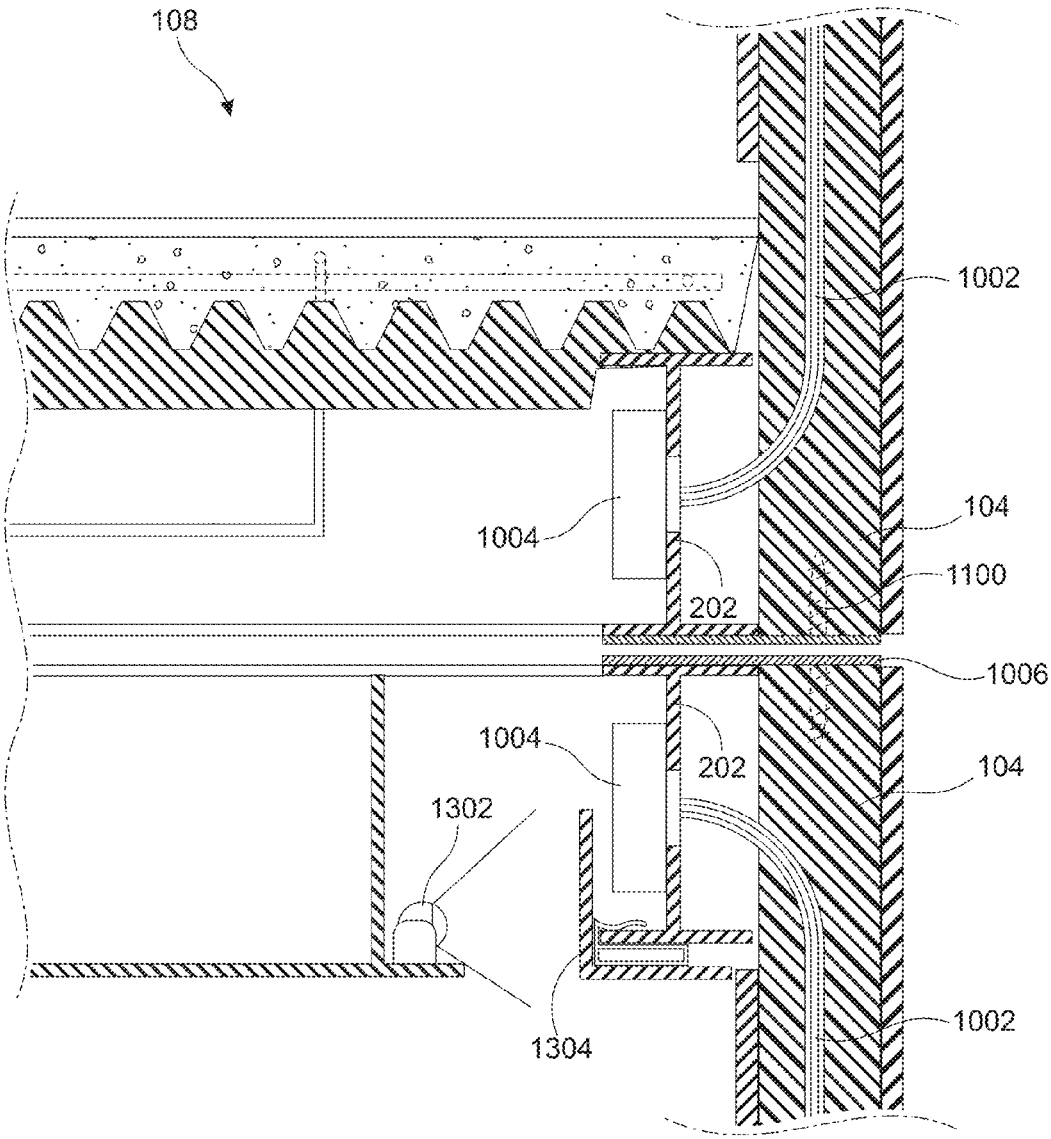
FIG. 13 is an elevation view of a close-up of a first floor connected to a second floor of the present invention.

FIG. 13 is a blown-up illustration of a ceiling/floor junction. As shown, the floor 108 and ceiling 106 are each resting on a beam 202, specifically, an "I"-beam attached by a connector plate 1006. Due to this configuration an open space is created between the ceiling of the first floor and the floor of the second floor. This open space creates additional channels and passageways through which electrical wires and plumbing may traverse.

Within the ceiling 106 is a light emitting diode (LED) 1302 type lighting system, such as, but not limited to, those sold by Philips. To reduce the harshness of the light, the LED 1302 is reflected against a reflector 1304 to light up a room. LED light sources 1302 are far more energy efficient than standard light bulbs, and their use herein is consistent with the goal of creating affordable, sustainable buildings that are environmentally-sensitive. On or within the wall panels 104, cabinets may be installed, veneered with recycled tires.

Figure 14A:
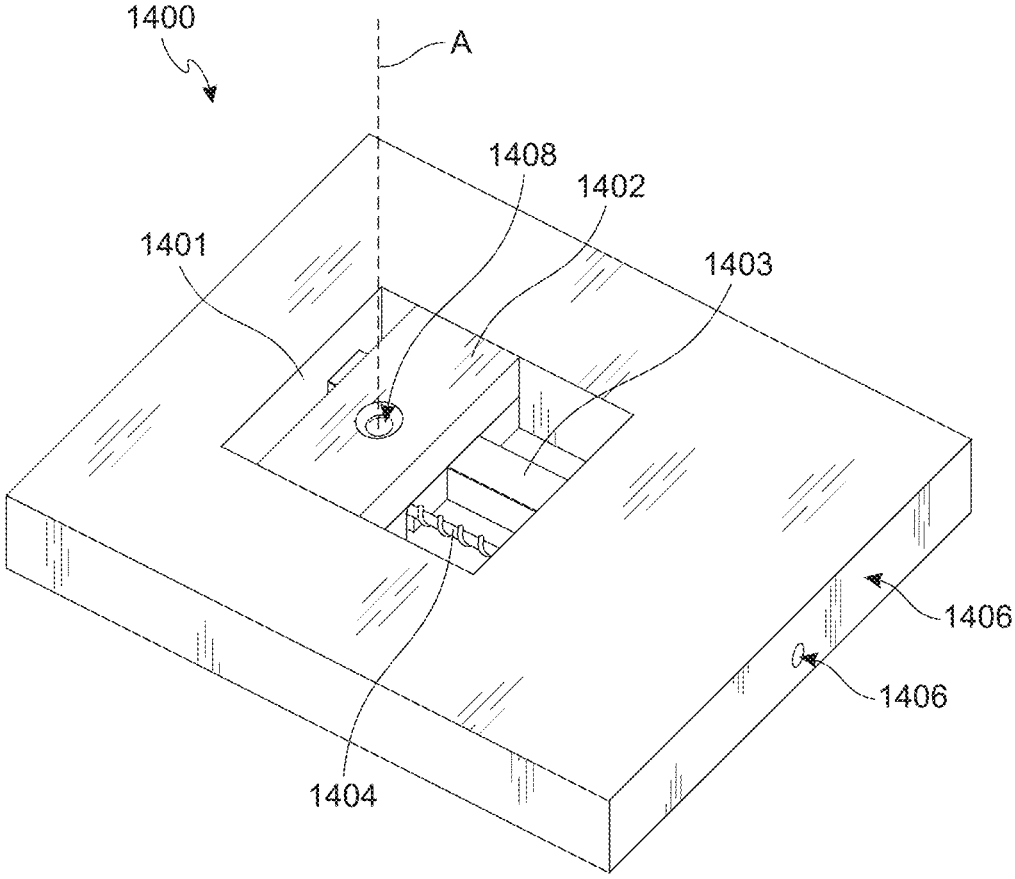
FIG. 14A is a partial perspective view of an embodiment of an adjustable plate of the present invention.
Figure 14B:
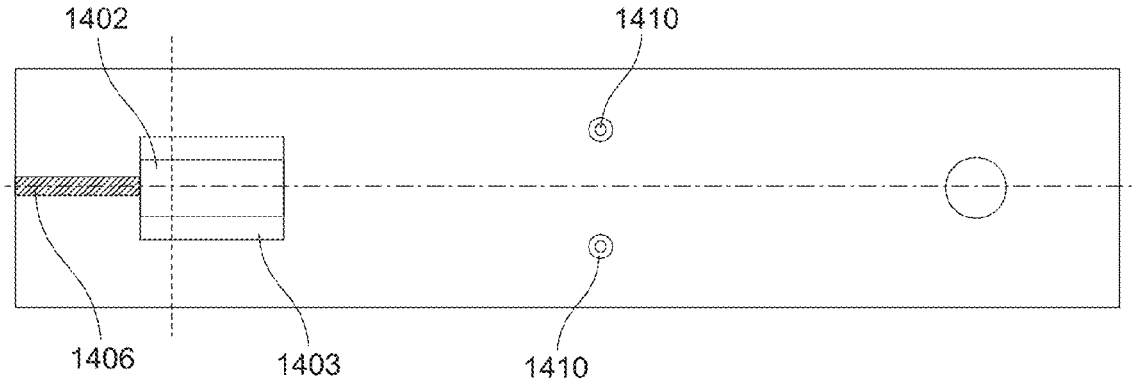
FIG. 14B is a top view of an embodiment of an adjustable plate of the present invention.
Figure 14C:
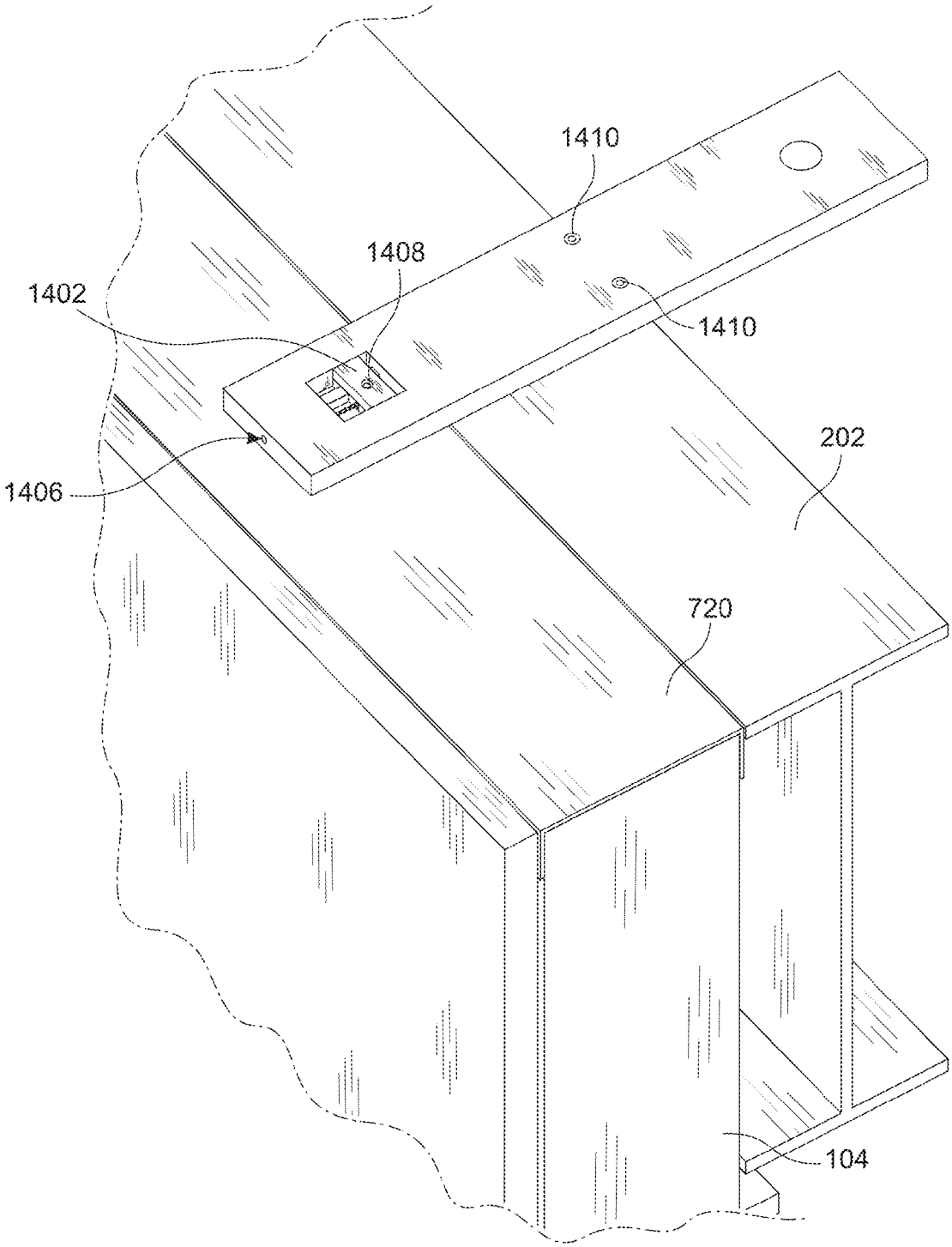
FIG. 14C is a top perspective view of an embodiment of an adjustable plate connected to the frames of the present invention.

In some embodiments, as shown in FIGS. 14A and 14C, the connector plate 1006 may be an adjustable plate 1400 comprising an adjustment space 1401, an adjustment slide 1402 within the adjustment space 1401, a track 1403 within the adjustment space 1401 for the adjustment slide 1402 to slide on, a threaded pipe 1406 at a first side 1412 of the adjustable plate 1400 providing a channel from the first side 1412 of the adjustable plate 1400 to the adjustment slide 1402, an adjustment screw 1404 housed within the threaded pipe 1406 and attached to the adjustment slide 1402, and a fixed orifice 1410 at a second end 1414 of the adjustable plate 1400. The adjustment slide 1402 comprises an adjustment slide attachment orifice 1408. The adjustment slide attachment orifice 1408 defines an axis A that is non-parallel, and preferably perpendicular, to the track 1403 to allow the adjustment slide 1402 to be attached to a frame 104.

As shown in FIG. 14C, a wall panel 104, or alternatively a beam, operatively attaches to the adjustable plate 1400 at the adjustment slide 1402 through the adjustment slide attachment orifice 1408. A beam 202 operatively attaches to the adjustable plate 1400 through the fixed attachment orifice 1410. To precisely adjust the placement of wall panel 104, a screw driver may be inserted into the threaded pipe 1406 and the adjustment screw 1404 may be rotated clockwise or counterclockwise to move the adjustment slide 1402 across the adjustment space 1401.

Figure 15A:
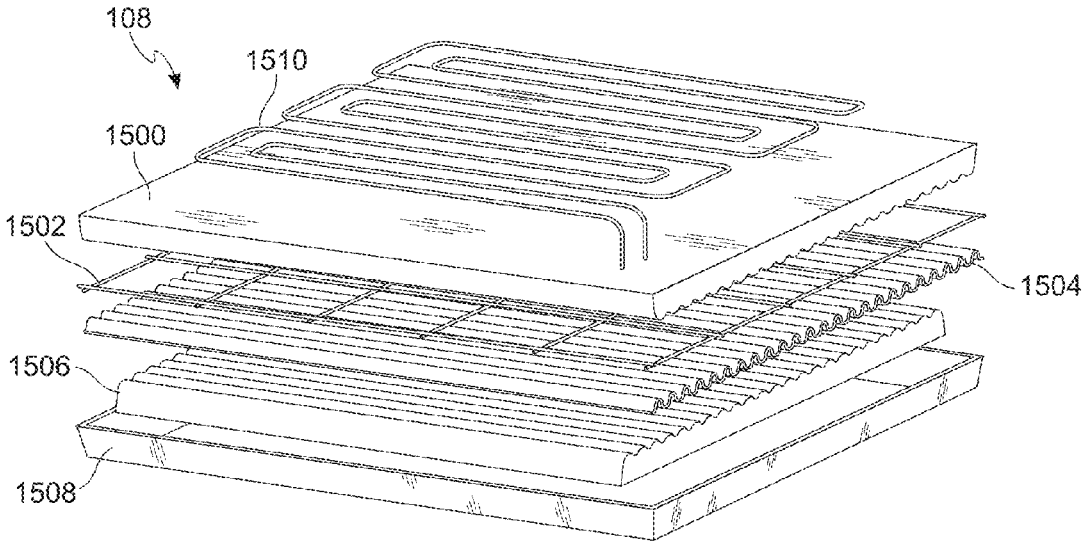
FIG. 15A is an exploded view of an embodiment of a floor panel of the present invention.
Figure 15B:
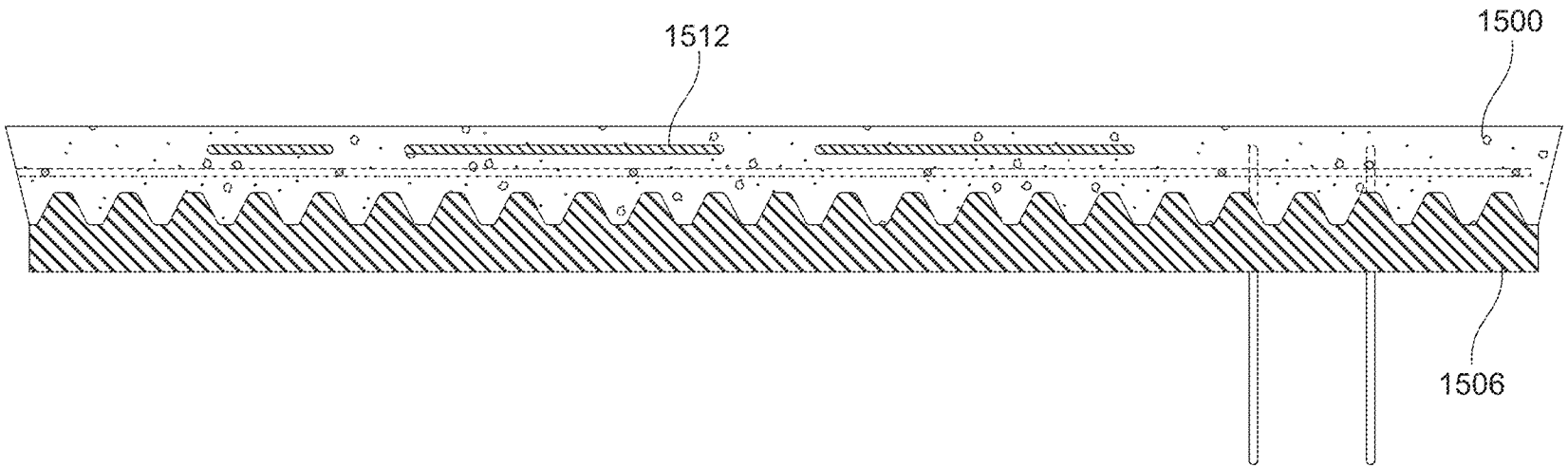
FIG. 15B is a side view of an embodiment of a floor panel of the present invention.

As shown in FIG. 15A the floor panel 108 comprises a concrete slab 1500, a steel bar 1502 below the concrete slab 1500 for reinforcement, a metal decking 1504 below the steel bar 1502, an floor insulation layer 1506 below the metal decking 1504, and a rubber gasket 1508 to form a tight seal with the frames or adjacent floor panels. The floor panels 108 may further comprise a heating element 1510 to provide heat to a room. The concrete slab 1500 may contain heat channels 1512 interweaving throughout the concrete slab 1500 through which a heating element 1510 may be laid. The concrete slab 1500 may comprise up to 40% fly ash.

The heating element 1510 may be an electric filament or a heating pipe carrying water. In embodiments in which the heating element 1510 is the pipe, a water source may be placed on the roof to be heated during the day by the sunlight. The water source may be contained in a greenhouse-type containment or enclosure to heat up the water even on cold days. By night, once the water has been sufficiently heated by the sun, the water can be sent through the heating pipes to heat up the floor panels to heat the rooms by heat conduction.

Figure 16A:
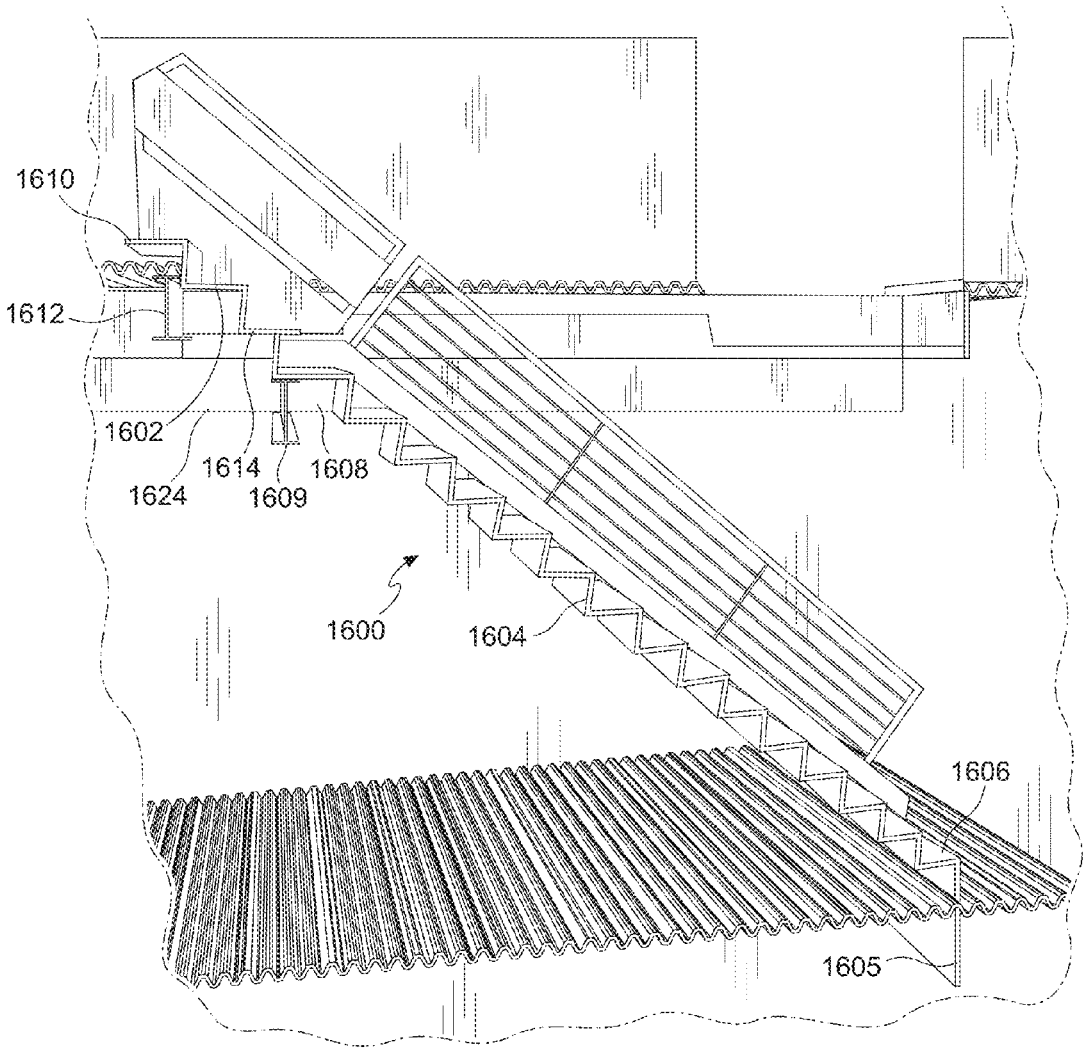
FIG. 16A is an elevation view of an embodiment of a staircase of the present invention.
Figure 16B:
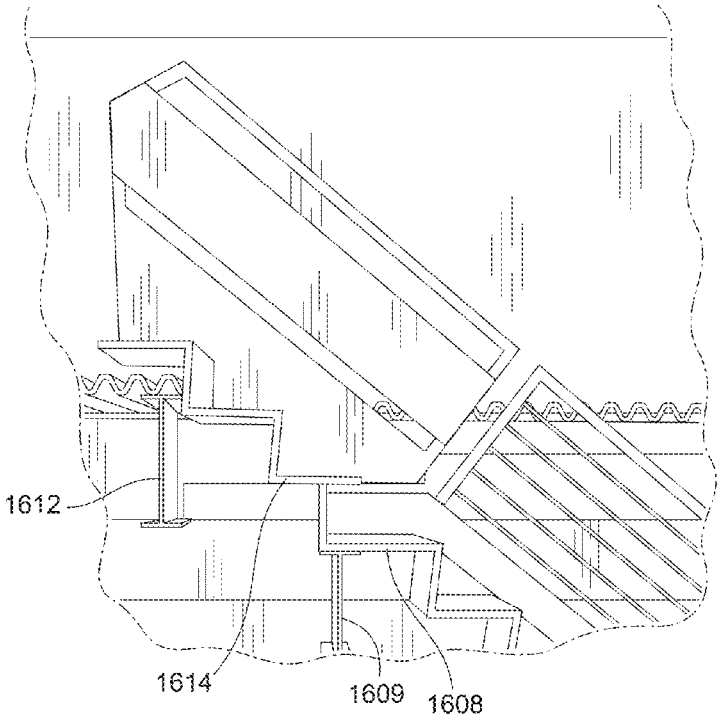
FIG. 16B is a close-up perspective view of an embodiment of a top portion of the staircase shown in FIG. 16A.
Figure 16C:
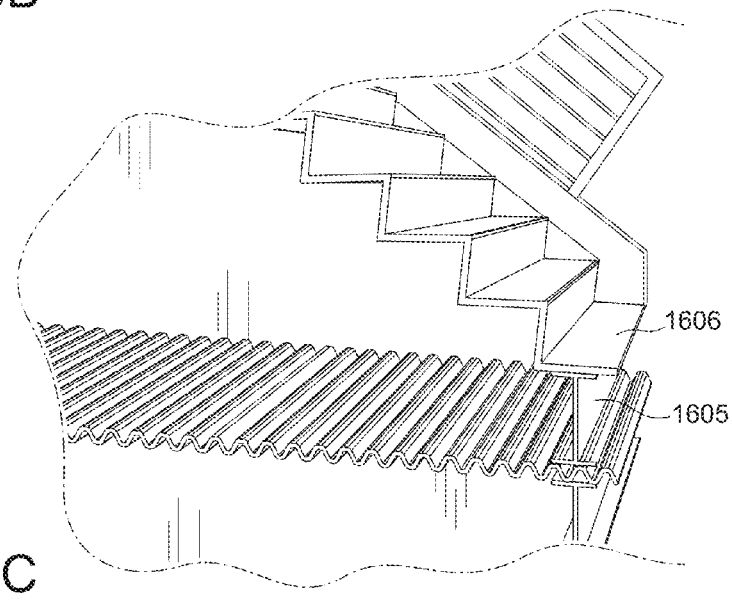
FIG. 16C is a close-up perspective view of the bottom portion of the staircase shown in FIG. 16A.

In multi-story buildings, staircases 1600 are required to move from floor to floor as shown in FIG. 16A. Typically, staircases 1600 are created on site. In the present invention, one or more styles of staircases 1600 may be part of the prefabricated library of parts ready for installation. As shown in FIG. 16A, a representative staircase 1600 comprises a top staircase 1602 and a bottom staircase 1604. The lowest step of the bottom staircase 1606 is attached to the first floor frame module at a floor beam 1605, and the highest step of the bottom staircase 1608 is connected to the first floor frame module at a ceiling beam 1609. The highest step of the top staircase 1610 is attached to the floor beam 1612 of the second floor frame module and the lowest step of the top staircase 1614 is free. The top staircase 1602 and the bottom staircase 1604 remain separate and physically disconnected, but function together as a complete staircase 1600.

Because the building 100 is assembled from a library of parts, it is important to assure that each connection point is properly sealed and weatherproofed. As shown in FIG. 17, a water seal 1700 may be inserted adjacent to the connector plates 1006 on the side adjacent to the outdoors to further improve the weatherproofing. The water seal 1700 is a watertight seal that prevents water from seeping in between the connector plates 1006 and entering the building 100. The water seal 1700 combines factory-applied low modulus silicon acrylic impregnated with expanding foam sealant and closed cell foam into a unified binary sealant system. The water seal 1700 is capable of lateral movements up to 50%-100% of mean temperature joint size and provides an economical watertight silicone seal when compressed a bellows is created as the joint moves the bellow fold and unfold the silicone primary seal in thus virtually. The water seal is greased and lubricated with specialty synthetic, water resistant, no melting grease for the ease of installation. The water seal 1700 may be made of a material that expands when exposed to air, such as those sold by EMSEAL (see www.emseal.com).

The size of the waterproofing membrane is standardized to reduce, recycle, and reclaim materials. In addition, a color coding scheme may be implemented to quickly and easily identify specific parts and determine the proper connection. Suitable waterproofing membranes for panel-to-panel connection include sealants and expansion joints sold by EMSEAL Corporation. Color seal combines factory applied low modulus silicone acrylic impregnated expanding foam sealant and closed cell (EVA) foam into a unified binary sealant system.

A new water seal 1700 may be opened and inserted into a pocket created by the thickness of plates. Once the water seal 1700 is exposed to the air, the water seal 1700 will expand, thereby sealing the pocket.

Figure 17A:
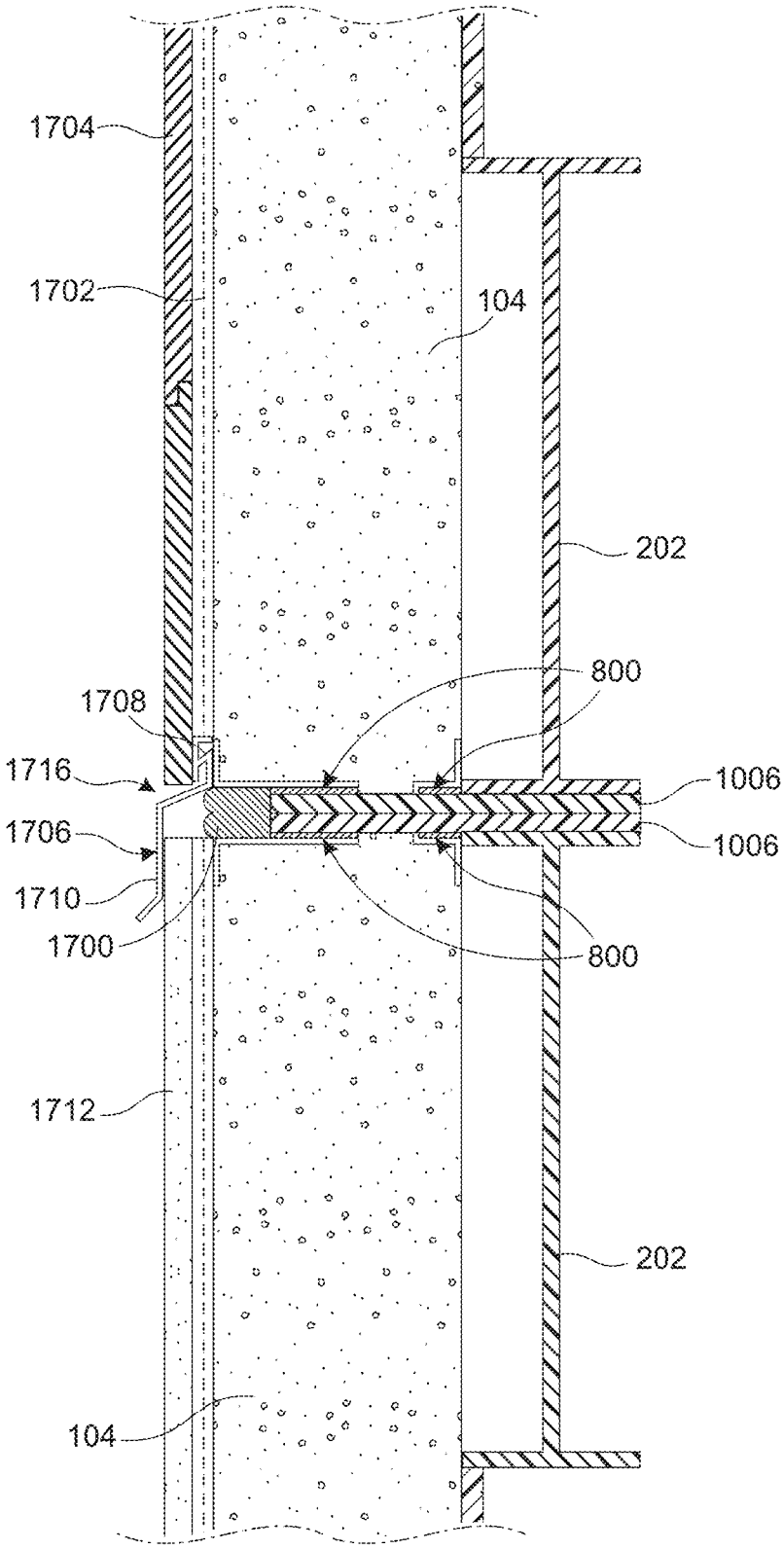
FIG. 17A is a close-up side view of a connection between two frames.

As shown in FIG. 17A, additional weatherproofing barriers may be applied to the outer side of a wall panel. In some embodiments, a weatherproofing barrier 1702, such as Bluskin VP™ may line the outer side of the wall panel 104. Sidings 1704, 1712 may be attached to the wall panel 104 adjacent to the weatherproofing barrier 1702 to complete the exterior of the building. In some embodiments, where there are gaps 1716 between sidings 1704, 1712 a metal flashing 1706 may be inserted into the gap 1716 to prevent water from leaking into the building. The metal flashing 1706 is a piece of metal generally bent into a modified "Z" shape. A first portion 1708 of the metal flashing 1706 is inserted in between the upper siding 1704 and the upper wall panel. A second portion 1710 of the metal flashing 1706 overlaps onto the outer surface of the lower siding 1712. Thus, any water running from the upper siding 1704 to the lower siding 1712 runs along the metal flashing 1706 to the outer side of the lower siding 1712, thereby preventing any water from entering into the building 100.

Figure 17B:
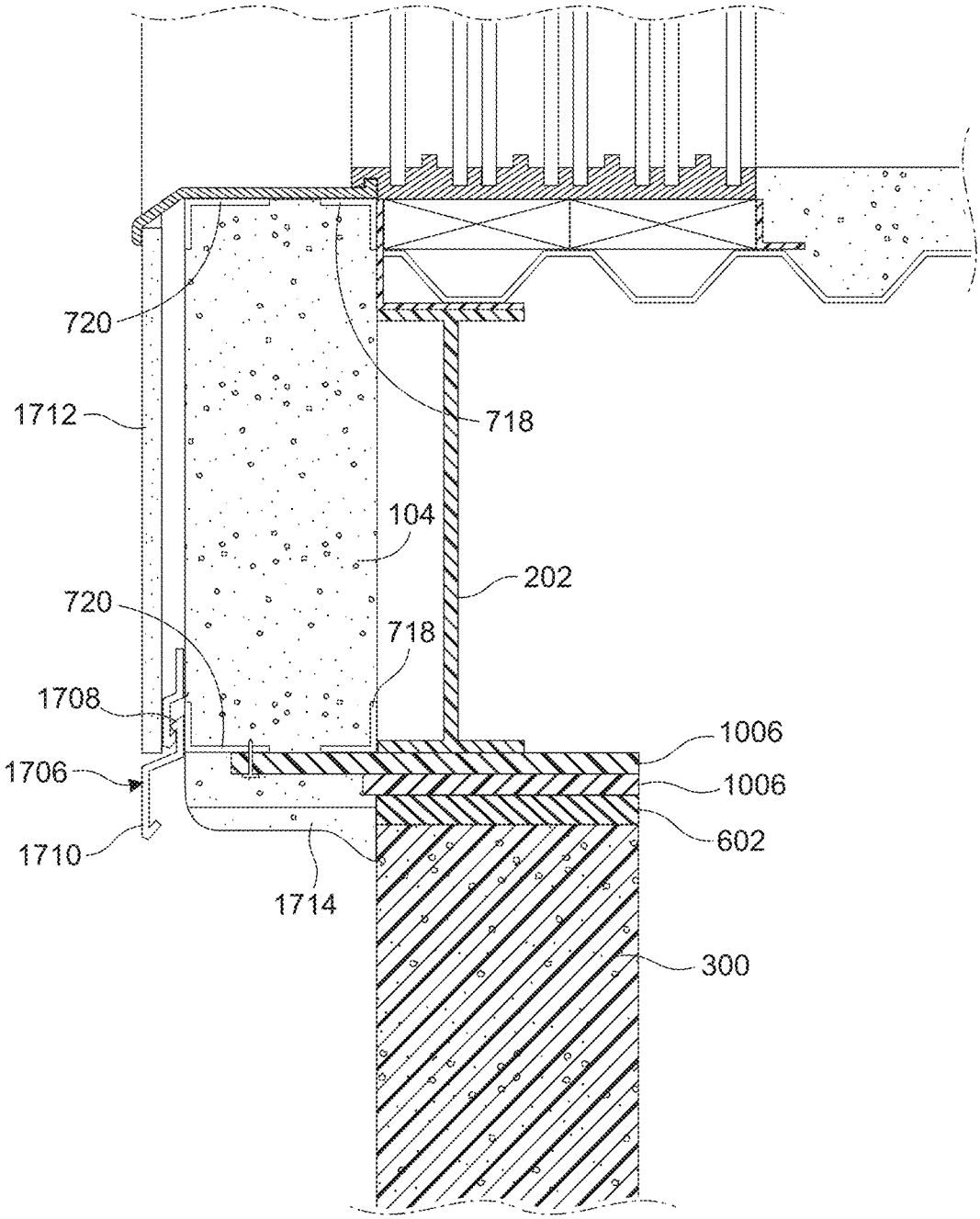
FIG. 17B is a close-up side view of a connection between a frame and a foundation.

The metal flashing 1706 may also be used at the junction where a wall panel 104 meets the ground on the outside as shown in FIG. 17B. The first portion 1708 of the metal flashing 1706 is inserted in between the siding 1712 and the wall panel 104, while the second portion 1710 of the metal flashing 1706 is inserted into the ground. To prevent water from seeping up into the wall panel 104 from the ground, a sealant 1714, such as a spray foam, may be used to seal the bottom portion of the wall panel 104.

Figure 18A:
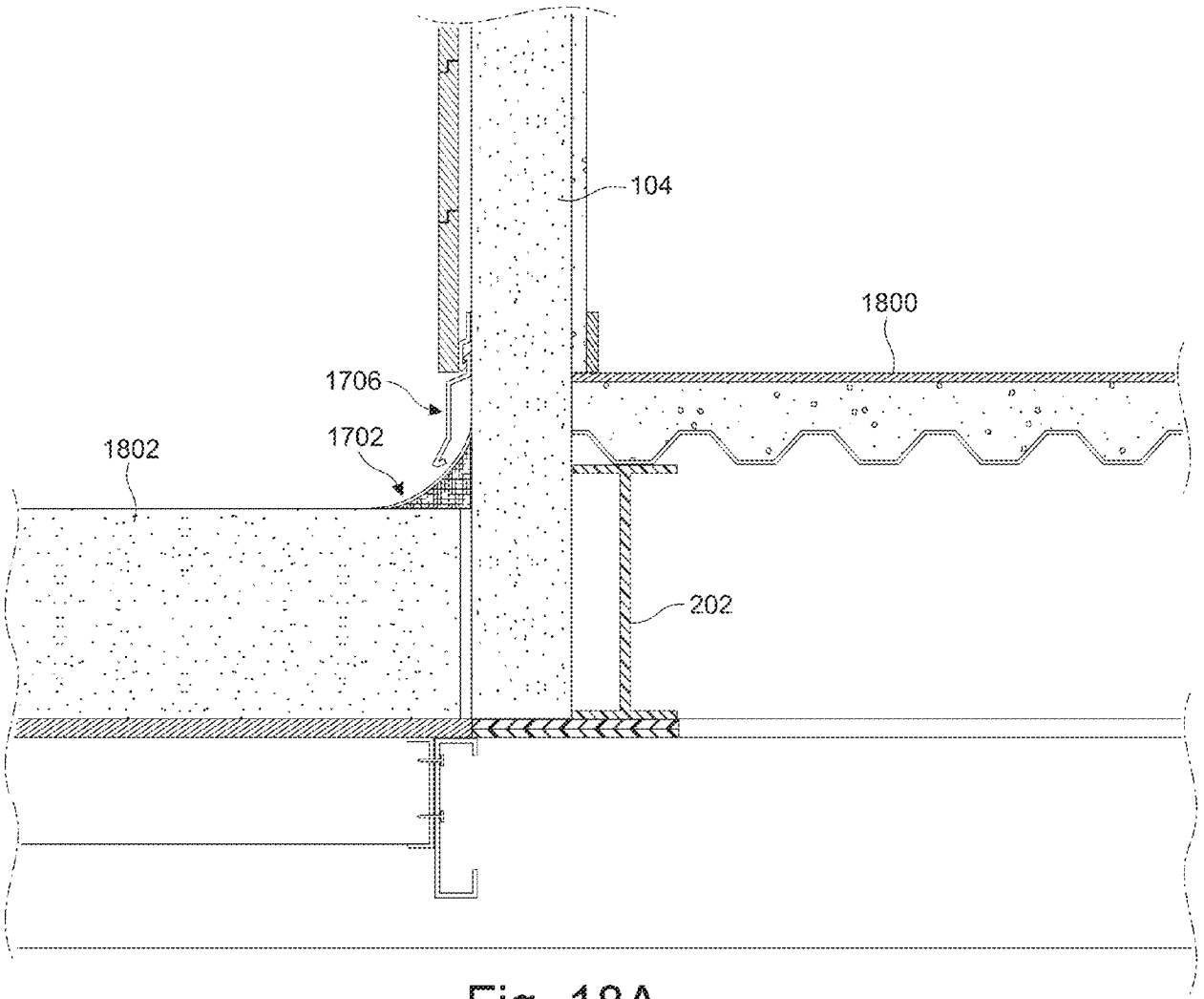
FIG. 18A is a close-up side view showing a portion of an embodiment of a deck of the present invention.
Figure 18B:
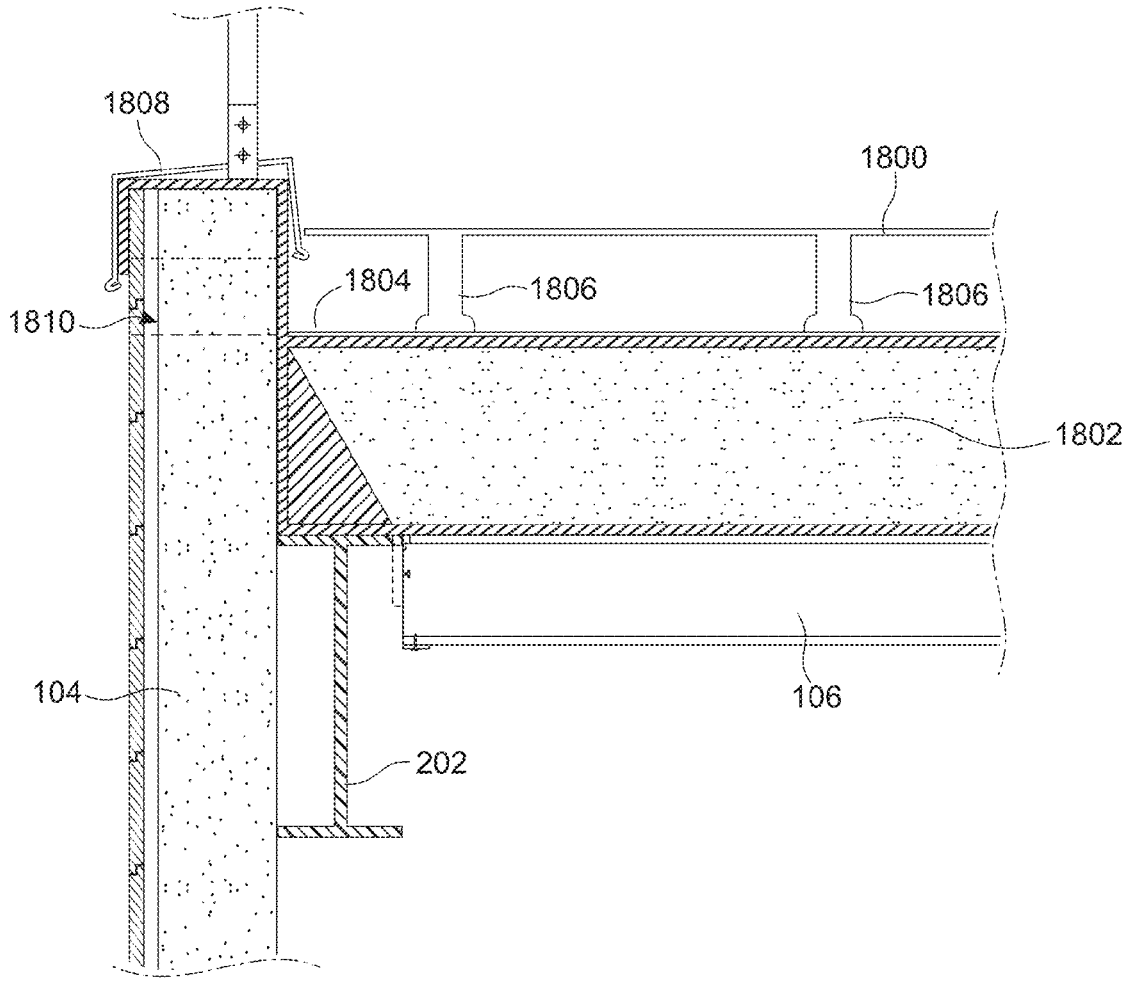
FIG. 18B is another close-up side view showing a portion of an embodiment of a deck of the present invention.
Figure 18C:
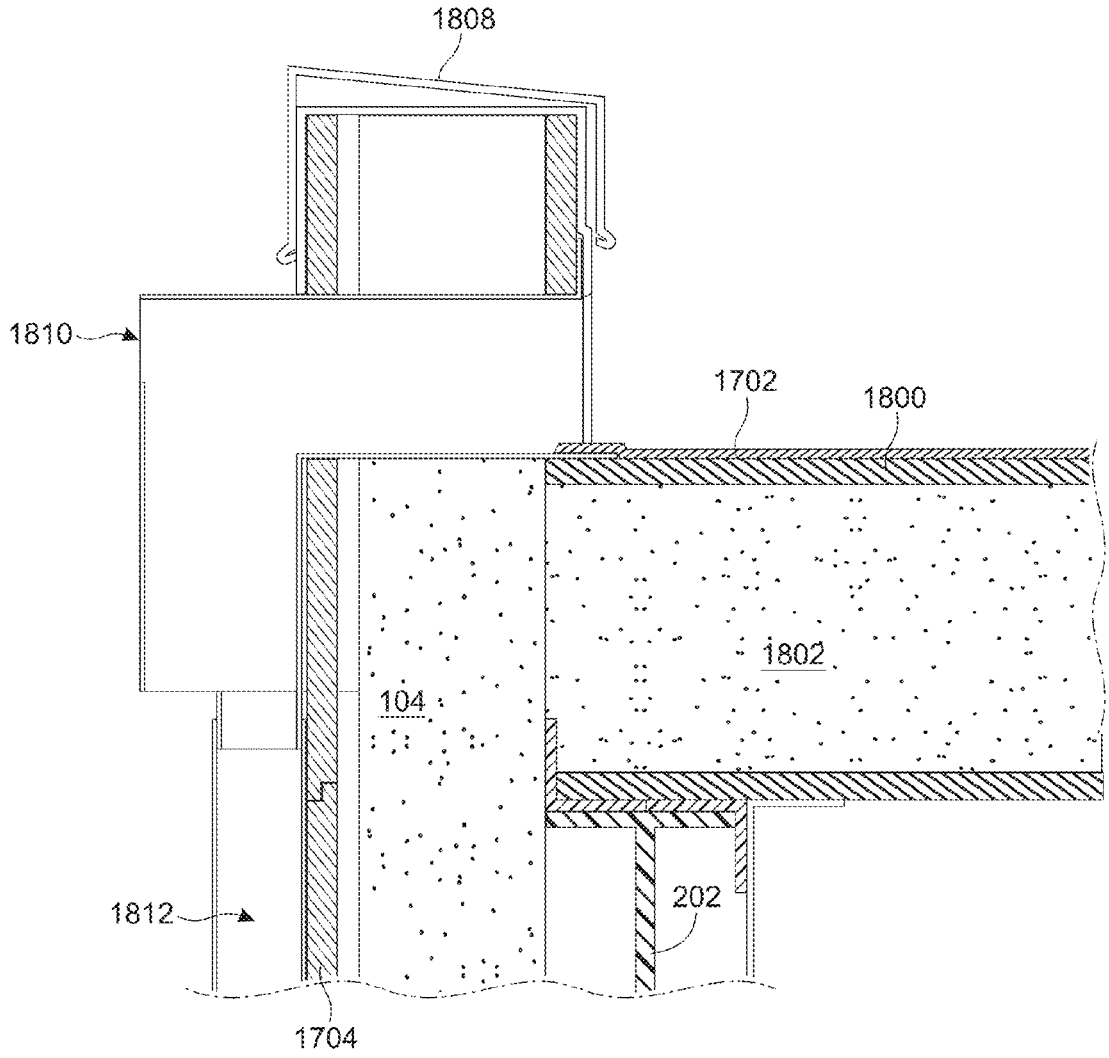
FIG. 18C is another close-up side view showing a portion of an embodiment of a deck of the present invention.

To assure proper run-off of any water that may fall and collect on the deck 1800, the deck 1800 comprises a drainage system as shown in FIG. 18A-C. The deck 1800 is located directly above the ceiling 106, supported by a plurality of ceiling beams 1801. In between the ceiling 106 and the deck 1800 is a tapered insulation 1802. In some embodiments, the deck 1800 may be elevated on a support system 1806. A waterproofing liner or membrane 1804 substantially covers the top of the wall panel 104 and a side of the wall panel adjacent to the deck and extends continuously down in between the deck 1800 and the tapered insulation 1802 to prevent water from seeping into the tapered insulation 1802. The top of the wall panel 104 may further comprise a steel coping 1808 to cap the top of the wall panel 104 and prevent water from seeping into the wall panel 104. In some embodiments, the wall panel 104 may have a scupper opening 1810 leading to a down spout 1812. This allows any water to run-off along the outer walls.

Any recyclable material may be used to construct the recyclable building such as plastic, glass, metals, textiles, timber, and the like.

Constructing a recyclable building comprises building at least one frame module 102, attaching at least the first frame module 102 to a foundation 300; inserting or attaching a plurality of panels 104, 106, 108, and/or 110 into/onto the first frame module 102 to form a room comprising a floor, a ceiling and at least one wall, thereby constructing a recyclable building 100. This process may be repeated to attach additional frame modules to the foundation; attaching additional frame modules to previously attached frame modules; and, inserting panels into each additional frame module to form a plurality of rooms for larger buildings.

Each room may be constructed by first erecting the frame module 102 then inserting or attaching the panels 104. Alternatively, each room may be constructed by concurrently assembling the frame module 102 and inserting or attaching the panels 104. Once a room has been constructed it may be fastened to another room as described herein. This process may be repeated until the entire building is complete.

In embodiments utilizing the improved wall panels 1900, a foundation may be created with grooves configured to receive the bottom portions 1906 of the main wall section 1902. The wall panels 1900 can simply be inserted into the grooves to erect the walls of the building. Because of the unique configuration of the wall panel 1900, a ceiling panel is simply laid on top of the ledge 1956 of the main wall section. The first set of elongated studs 1940 forming a barrier helps to keep the ceiling panels in place.

Assembling a first room 120 with a second room 122 may be accomplished by lifting a room with a crane and positioning the room in a predetermined location either on the foundation or on top of another room for multi-story buildings. Each room may have a plurality of lifting elements. A lifting element may be any surface, protrusion, loop, orifice, and the like that serves as an attachment site for a lifting machine, such as a crane. For example, the surface or protrusion may be a powerful magnet. The lifting machine may utilize an electromagnet to attach to the magnetic surface or protrusion in preparation for lifting the room. In another example, the lifting machine may utilize hooks, cables, chains, ropes, and the like to hook, strap, or otherwise fasten to the protrusion, loop, or orifice in preparation for lifting the room.

The lifting elements may be on the panels 104, 106, 108, or 110 and/or the frames 102 that make up the ceiling of a room. The lifting elements may be strategically positioned so that the room is balanced when lifted at the lifting elements. A computer software program may be created to calculate the precise location of the lifting elements based on the dimensions of the room and the weights of the frames and panels.

In other words, because the association or attachment of variously-sized and variously-weighted panels to the frames results in different centers of gravity and different weight distribution for each completed frame, it is important to determine the appropriate points on the frame for a crane, hoist, or other lifting apparatus to attach so that the frame can be transported to, and placed within, the building under construction in a level, even, and safe manner. To accomplish this, it is understood that software programs or codes may be developed so as to ascertain the appropriate attachment points on the frame module for proper balance, as depicted in FIG. 5.

Each constituent part has a known measurement and weight. As such, by selecting the constituent parts and inputting the precise arrangement, the software can calculate the center of gravity of a frame module and determine which set of lifting elements to employ for proper balancing.

Because of the library of parts system, a website could be created in which a potential buyer could easily construct a virtual model of his house according to his preferences on a computer. The website could be guided, asking the potential buyer questions to guide him in selecting the appropriate constituent parts and arranging the constituent parts in a practical manner. Once completed and checked for structural integrity and compliance with housing and building codes, this virtual model could be converted to an architectural plan and submitted to a manufacturer. The ordered constituent parts would be delivered to the construction site and the building built according to the design specifications of the architectural plan.

Passive and active design principles may be easily taken into consideration in constructing a building according to the present invention. Knowing the location of the building site, the buildings may be arranged in a proper orientation so as to take advantage of cross ventilation, location of sun exposure, shading and thermo mass, and the like, according to energy needs of the building. Utilizing the building system of the present invention, panels may be replaced quickly and easily to suit the needs of the occupants. Walls can be easily changed into windows or sliding glass doors, and vice versa. Computer energy modeling software can be written and utilized to automatically create a building with the walls, windows, doors, and hallways in the proper orientation to maximize the desires of the occupant. For example, a user may input the address or longitude and latitude of the construction site and the program can collect data to determine the weather conditions, the sunlight exposure, the wind speed and direction. The occupants may further input information regarding where they would like sunlight exposure to hit at what time of the day, where they would like the wind to circulate through, and so on. The computer program can then output various modeling designs that would best accommodate the desires of the occupants.

The building system of the present invention not only makes construction and remodeling quicker and easier but also, makes disassembly or destruction easier. The building may be recycled by disassembling the building in the reverse order as it was assembled. Thus, a room may be detached from the foundation or another room. Then the room may be removed by attaching hooks and cables to the lifting elements of the room and using a crane to hoist the room. Once the room is detached the panels 104, 106, 108 and/or 110 may be removed, leaving the frame module 102. The frame module 102 may then be disassembled into its individual frames 200, 202. These pieces may then be recycled when constructing the next building. Alternatively, once the room has been detached, the panels and frames may be disassembled in any logical order. In some embodiments, it may be preferable to transport a detached room without disassembling the room into its constituent parts.

Additionally, because of the manner of construction described herein, the remodeling of a home, portions of a home, an office building, or portions of an office building, becomes more straightforward, less costly, and less time consuming. One of the frequent problems with home remodeling is that walls of the home must be destroyed and ultimately rebuilt, and a substantial amount of waste is created. The process of remodeling is also very time consuming.

The present invention allows for straightforward, efficient, and relatively rapid disassembly of portions of a structure constructed in the manner described herein, and replacement of frames and panels according to a customer's preferences.

Little waste is generated and the process can be performed quickly and for substantially less cost that a home or office remodel.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A wall panel for building a sustainable building, comprising:

a. a main wall section having
  i. a top,
  ii. a bottom opposite the top,
  iii. a first side adjacent to the top and the bottom,
  iv. a second side opposite the first side and adjacent to the top and the bottom,
  v. an inside-facing surface bound by the top, bottom, first side, and second side,
  vi. an outside-facing surface opposite the inside-facing surface, the outside-facing surface bound by the top, bottom, first side, and second side,
  vii. a height measured from the top to the bottom,
  viii. a width measured from the first side to the second side, and
  ix. a thickness measured from the inside-facing surface to the outside-facing surface;

b. an auxiliary wall section having
  i. a top,
  ii. a bottom opposite the top,
  iii. a first side adjacent to the top and the bottom,
  iv. a second side opposite the first side and adjacent to the top and the bottom,
  v. an inside-facing surface bound by the top, bottom, first side, and second side of the auxiliary wall section,
  vi. an outside-facing surface opposite the inside-facing surface, the outside-facing surface bound by the top, bottom, first side, and second side of the auxiliary wall section,
  vii. a height measured from the top to the bottom of the auxiliary wall section,
  viii. a width measured from the first side to the second side of the auxiliary wall section,
  ix. a thickness measured from the inside-facing surface to the outside-facing surface of the auxiliary wall section;

c. a first set of elongated studs embedded in the outside-facing surface of the main wall section, each elongated stud in the first set of elongated studs having a length;

d. a second set of elongated studs embedded in the inside-facing surface of the main wall section, each elongated stud in the second set of the elongated studs having a length, e. wherein the auxiliary wall section is positioned on top of the main wall section to define a total height of the wall panel, f. wherein the length of each elongated stud of the first set of elongated studs is greater than the height of the main wall section at locations where each elongated stud of the first set of elongated studs has been embedded, and g. wherein the length of each elongated stud of the second set of elongated studs is equivalent to the height of the main wall section at locations where each elongated stud of the second set of elongated studs has been embedded.

2. The wall panel of claim 1, wherein the first set of elongated studs and a top surface of the main wall section define a ledge to support a ceiling section, wherein the first set of elongated studs creates a barrier for the ceiling section.

3. The wall panel of claim 2, wherein the thickness of the auxiliary wall section is smaller than the thickness of the main wall section.

4. The wall panel of claim 3, further comprising an L-shaped angle, the L-shaped angle, comprising:

a. a vertical section generally rectangular in shape defined by a first long edge, a second long edge opposite the first long edge, a first short edge adjacent to the first long edge and the second long edge, and a second short edge opposite the first short edge and adjacent to the first long edge and the second long edge, and b. a horizontal section generally rectangular in shape defined by a first long edge, a second long edge opposite the first long edge, a first short edge adjacent to the first long edge and the second long edge, and a second short edge opposite the first short edge and adjacent to the first long edge and the second long edge, c. wherein the vertical section and the horizontal section are perpendicular to each other and the second long edge of the vertical section is attached to the first long edge of the horizontal section, d. wherein the horizontal section is positioned on the ledge of the main wall section.

5. The wall panel of claim 1, further comprising a spacer positioned in between the main wall section and the auxiliary wall section to adjust the total height of the wall panel.

6. The wall panel of claim 1, further comprising a cross brace attached to the outside-facing surface of the main wall section and the outside-facing surface of the auxiliary wall section.

7. A wall panel for building a sustainable building, comprising:

a. a main wall section having
  i. a top,
  ii. a bottom opposite the top,
  iii. a first side adjacent to the top and the bottom,
  iv. a second side opposite the first side and adjacent to the top and the bottom,
  v. an inside-facing surface bound by the top, bottom, first side, and second side;
  vi. an outside-facing surface opposite the inside-facing surface, the outside-facing surface hound by the top, bottom, first side, and second side;
  vii. a height measured from the top to the bottom,
  viii. a width measured from the first side to the second side, and
  ix. a thickness measured from the inside-facing surface to the outside-facing surface;

b. a first set of elongated studs embedded in the outside-facing surface of the main wall section, each elongated stud in the first set of elongated studs having a length, c. a second set of elongated studs embedded in the inside-facing surface of the main wall section, each elongated stud in the second set of the elongated studs having a length, d. wherein the length of at least one elongated stud of the first set of elongated studs is greater than the height of the main wall section measured where the at least one elongated stud of the first set of elongated studs has been embedded, and e. wherein the length of at least one elongated stud of the second set of elongated studs is equivalent to the height of the main wall section measured where the at least one elongated stud of the second set of elongated studs has been embedded.

8. The wall panel of claim 7, wherein the first set of elongated studs and a top surface of the main wall section define a ledge to support a ceiling section, wherein the first set of elongated studs creates a barrier for the ceiling section.

9. The wall panel of claim 7, further comprising an L-shaped angle, the L-shaped angle, comprising:

a. a vertical section generally rectangular in shape defined by a first long edge, a second long edge opposite the first long edge, a first short edge adjacent to the first long edge and the second long edge, and a second short edge opposite the first short edge and adjacent to the first long edge and the second long edge, and b. a horizontal section generally rectangular in shape defined by a first long edge, a second long edge opposite the first long edge, a first short edge adjacent to the first long edge and the second long edge, and a second short edge opposite the first short edge and adjacent to the first long edge and the second long edge, c. wherein the vertical section and the horizontal section are perpendicular to each other and the second long edge of the vertical section is attached to the first long edge of the horizontal section, d. wherein the horizontal section is positioned on the top of the main wall section.

10. The wall panel of claim 7, further comprising a cross brace attached to the outside-facing surface of the main wall section.

11. The wall panel of claim 7, further comprising an auxiliary wall section having:

a. a top, b. a bottom opposite the top, c. a first side adjacent to the top and the bottom, d. a second side opposite the first side and adjacent to the top and the bottom, e. an inside-facing surface bound by the top, bottom, first side, and second side of the auxiliary wall section;

f. an outside-facing surface opposite the inside-facing surface, the outside-facing surface bound by the top, bottom, first side, and second side of the auxiliary wall section;

g. a height measured from the top to the bottom of the auxiliary wall section, h. a width measured from the first side to the second side of the auxiliary wall section, i. a thickness measured from the inside-facing surface to the outside-facing surface of the auxiliary wall section, j. wherein the auxiliary wall section is positioned on top of the main wall section to define a total height of the wall panel.

12. The wall panel of claim 11, wherein the thickness of the auxiliary wall section is smaller than the thickness of the main wall section.

13. The wall panel of claim 11, further comprising a cross brace attached to the outside-facing surface of the main wall section and the outside-facing surface of the auxiliary wall section.

14. A wall panel for building a sustainable building, comprising:

a. a main wall section having an inside-facing surface and an outside-facing surface opposite the inside-facing surface;

b. a set of long elongated studs embedded in the outside-facing surface of the main wall section, each long elongated stud in the set of long elongated studs having a length;

c. a set of short elongated studs embedded in the inside-facing surface of the main wall section, each short elongated stud in the set of short elongated studs having a length;

d. wherein the length of at least one long elongated stud is greater than a height of the main wall section at a first location where the at least one long elongated stud has been embedded, and e. wherein the length of at least one short elongated stud is equivalent to the height of the main wall section at a second location where the at least one short elongated stud has been embedded.

15. The wall panel of claim 14, wherein the set of long elongated studs and a top surface of the main wall section define a ledge to support a ceiling section, wherein the set of long elongated studs creates a barrier for the ceiling section.

16. The wall panel of claim 15, further comprising an L-shaped angle having a vertical section connected perpendicularly to a horizontal section, with the horizontal section positioned on the ledge of the main wall section and the vertical section adjacent to the barrier to receive the ceiling section.

17. The wall panel of claim 14, further comprising a cross brace attached to the outside-facing surface of the main wall section.

18. The wall panel of claim 14, further comprising an auxiliary wall section having an inside-facing surface and an outside-facing surface opposite the inside-facing surface positioned on top of the main wall section.

19. The wall panel of claim 18, wherein a thickness of the auxiliary wall section is smaller than a thickness of the main wall section.

20. The wall panel of claim 18, further comprising a cross brace attached to the outside-facing surface of the main wall section and the outside-facing surface of the auxiliary wall section.

* * * * *